US010349706B2

(12) United States Patent
Angelini et al.

(10) Patent No.: US 10,349,706 B2
(45) Date of Patent: Jul. 16, 2019

(54) RELEASABLE CONNECTING DEVICE

(71) Applicant: Mares S.p.A., Rapallo (GE) (IT)

(72) Inventors: Sergio Angelini, Lavagna (IT); Luciano Avataneo, Rapallo (IT); Dante Noceti, Santa Margherita Ligure (IT)

( * ) Notice: Subject to any disclaimer, the term of this patent is extended or adjusted under 35 U.S.C. 154(b) by 0 days.

(21) Appl. No.: 15/531,443

(22) PCT Filed: Dec. 9, 2015

(86) PCT No.: PCT/IB2015/059471
§ 371 (c)(1),
(2) Date: May 29, 2017

(87) PCT Pub. No.: WO2016/092484
PCT Pub. Date: Jun. 16, 2016

(65) Prior Publication Data

US 2017/0265599 A1 Sep. 21, 2017

(30) Foreign Application Priority Data

Dec. 12, 2014 (IT) ..... GE2014A0128

(51) Int. Cl.
*A44B 11/25* (2006.01)
*B63C 11/30* (2006.01)

(52) U.S. Cl.
CPC ..... *A44B 11/2569* (2013.01); *A44B 11/2592* (2013.01); *B63C 2011/306* (2013.01)

(58) Field of Classification Search
CPC ..... A44B 11/2569; A44B 11/2592; B63C 2011/306
See application file for complete search history.

(56) References Cited

U.S. PATENT DOCUMENTS 4,831,694 A * 5/1989 Kong ..... A44B 11/266 24/606
6,796,007 B1 * 9/2004 Anscher ..... A44B 11/2549 24/312

(Continued)

FOREIGN PATENT DOCUMENTS

| | | |
|---|---|---|
| EP | 1864586 | 12/2007 |
| EP | 2261592 | 12/2010 |
| WO | 2014064925 | 5/2014 |

*Primary Examiner* — Robert Sandy
*Assistant Examiner* — David M Upchurch
(74) *Attorney, Agent, or Firm* — Themis Law

(57) ABSTRACT

A device for reversibly connecting together a first element and a second element designed to be alternately connected and disconnected includes a male element inserted into a female element to move from a mutually disengaged state to a mutually engaged state and a slider for actuation/release of the engaged state, which is slidingly engaged by the male element into the female element. The relative movement of the actuation/release slider and the male element is transferred to first releasable locking members of the male element, which cooperate with corresponding second locking members of the female element to move from a stable locked state to a stable unlocked state of the male element by a movement of the slider in the direction of insertion. Furthermore, the male element includes a handle having the slider at least partially and slidingly housed therein.

9 Claims, 25 Drawing Sheets

(56) References Cited

U.S. PATENT DOCUMENTS

| | | | | |
|---|---|---|---|---|
| 7,243,376 | B2 * | 7/2007 | Johnson | F41H 1/02 2/102 |
| 8,522,410 | B2 * | 9/2013 | Parisi | A44B 11/2546 24/606 |
| 9,032,767 | B2 * | 5/2015 | Takahashi | A44B 11/2546 24/614 |
| 9,204,692 | B2 * | 12/2015 | Lee | A44B 11/2592 |
| 9,332,811 | B2 * | 5/2016 | Anderson | A44B 11/2592 |
| 9,354,023 | B1 * | 5/2016 | Rittenhouse, Jr. | F41H 1/02 |
| 9,468,781 | B2 * | 10/2016 | Eifler | A61M 16/0683 |
| 2002/0013107 | A1 * | 1/2002 | Angelini | B63C 11/30 441/88 |
| 2002/0092140 | A1 * | 7/2002 | Van Tassel | A44B 11/266 24/614 |
| 2003/0150088 | A1 * | 8/2003 | Turpin | A44B 11/263 24/579.09 |
| 2005/0074295 | A1 * | 4/2005 | Kawashima | B63C 11/30 405/186 |
| 2010/0043112 | A1 * | 2/2010 | Khandelwal | F41H 1/02 2/2.5 |
| 2010/0313392 | A1 * | 12/2010 | Anscher | A44B 11/266 24/616 |
| 2016/0198808 | A1 * | 7/2016 | Noceti | A44B 11/2592 24/606 |

* cited by examiner

RELEASABLE CONNECTING DEVICE

The present invention relates to a reversible connection device for reversibly connecting together a first element and a second element, said elements being designed to be alternately connected to and disconnected from each other.

The device comprises a male element, designed to be connected to one end of the first element, and which is inserted into a female element, designed to be connected to one end of the second element, such that the male element and the female element move from a mutually disengaged state to a mutually engaged state.

A slider is also provided for actuation/release of the engaged state, which actuation/release slider is slidingly engaged by the male element along the axis of insertion of the male element into the female element.

The relative movement of the actuation/release slider and the male element is transferred to first releasable locking members of the male element, which cooperate with corresponding locking members of the female element to move from a stable locked state to a stable unlocked state of the male element relative to the female element.

Particularly, the movement from the unlocked state to the locked state is obtained by an action of movement of the slider in the direction of insertion.

The device of the present invention falls within the range of quick release devices, such as buckles, which allow easy and quick connection and/or release of two elements.

One possible field of use of such devices is scuba diving, where such connection devices are used for connecting a weight pocket to the pocket of a scuba diving jacket.

Scuba diving jackets have pockets for containing ballast elements, which are designed to facilitate diving.

These ballasts are not directly introduced into the pockets of the jacket, but are generally placed in envelopes, until they reach the weight selected by the diver. Then, the envelope, which generally contains one or more ballasts, is introduced into the pocket of the jacket and has to be secured to the diver's jacket using a reversible connection device. The connection device of such ballast system should ensure two essential features: easy ballast removal in an emergency (intuitive movement that requires no particular attention and is automatically performed) and protection from accidental removal (as this would result in uncontrolled ascent of the diver, which might cause embolism or decompression sickness). Also, easy insertion and removal of the ballast envelope during donning and doffing is advantageous.

Prior art connection devices are generally formed as described hereinbefore, i.e. with a male element connected to a ballast-containing envelope, introduced into a female element which is joined to the diving jacket.

Therefore, reversible connection devices shall prevent inadvertent dropping of the envelope from the pocket of the jacket and allow easy removal thereof when the diver has to make an emergency ascent. Also, easy insertion and removal is desirable to facilitate donning and doffing, i.e. when the diver puts on or takes off the jacket.

Furthermore, the reversible connection device shall include easy-to-handle parts, as the diver may wear thick gloves that might hinder finger movement, prevent fine and accurate movements and limit tactile feedback.

Based on the aforementioned requirements, a number of documents disclose various configurations in use by prior art devices.

For example, EP 1520780 discloses a weight pocket dropping device composed of a flexible band which is fixed on the one hand to the weight pocket and on the other to the middle of a rigid blade element, which is introduced into the buckle attached to the sides of the buoyancy compensator vest. The blade element has a handle at its opposite end for easy grip.

The buckle on the vest consists of a moving eccentric lever which, in the closed position, uses teeth on the blade element to fix the pockets in containers located at the sides of the vest.

As the handle attached to the weight pockets is pulled out, the buckle lever lifts up and the blade element slides into the buckle and releases the pockets from the vest.

Therefore, the document discloses a ballast envelope to be introduced into a side pocket of the vest, which is connected to a male element designed to be inserted into a buckle placed on the outer lateral wall of the vest by means of a ribbon but, since the pockets are located out of the field of view of the diver, the above described release device facilitates weight release but actually prevents positioning of the weights when the vest is being worn.

A further arrangement is disclosed in EP1864586 which describes a device comprising a female element designed for snap engagement with a male element composed of a cap and a latch. By pulling the cap using a ribbon and a handle, the arms of the latch are bent, whereby the male element can be slid out of the sheath and the weights can be dropped off the pocket.

Nevertheless, the position of the female element in the weight pocket can hinder insertion of the weights into the pocket and of the male element into the female element.

In addition to the above mentioned documents, prior art devices are generally characterized by the use of buckles having a classical connection mechanism, i.e. with teeth on the male element engaging with appropriate seats in the female element upon deformation of the arms upon which they are mounted, and engagement being provided by full connection of the tooth in its corresponding seat. This connection cannot be always ensured, e.g. due to the wear of the male teeth or to the loss of elasticity and inadequate movement of the arms upon which the connection teeth are placed.

Devices are also known in the art which are generally characterized by complex constructions, using weight release actuation members, such as handles or ribbons, for more handleable and easier release of the weights.

Nevertheless, during diving, these elements may be accidentally hit or become entangled, thereby causing inadvertent dropping—and loss—of the weights.

Finally, once the male element has been disconnected from the female element, prior art releasable connection devices create objective problems when the diver is to connect the male element back to the female element, especially due to the critical conditions of use, i.e. in an underwater environment and with poor visibility by the diver, due to both limited availability of light and to the presence of the diving mask which reduces the field of view of the diver.

It shall be noted that one of the main drawbacks of prior art devices is accidental release of the male element from the female element.

Such accidental release may also be caused by inappropriate handling of the male element by the diver, which triggers the actuation mechanism that drops the weight off the pocket.

Indeed, the difficulty of performing fine movements with the fingers, due to the presence of diving gloves, can cause inadvertent triggering of the actuation mechanism.

Therefore, there is yet an unfulfilled need in the art for a reversible connection device that can obviate the above described drawbacks.

The present invention fulfills the above mentioned objects by providing a reversible connection device as described hereinbefore, in which the male element comprises a handle, having the slider at least partially and slidingly housed therein.

Preferably, the slider is disengaged from the handle.

In this configuration, from an active locked state, i.e. with the male element engaged with the female element, any collision against or inadvertent actuation of the handle by the user would not trigger the actuation mechanism that would lead to disengagement of the male element from the female element.

Therefore, inadvertent actuation may be avoided by allowing relative movement between the handle and the male element, to thereby create a clearance or a slack between the handle and the male element.

The clearance may be very little or even absent, based on the construction requirements of the device of the present invention.

Furthermore, the separation of the handle from the slider, particularly when the device of the present invention is designed for underwater use, allows easier insertion of the ballast pocket into the diving jacket with no risk that the slider may be moved forward before insertion of the entire male element in the female element, as the engaged/locked state might not otherwise be reached.

Therefore, the slider is independent of the handle, and the user can hold the handle without triggering the connecting mechanism.

Thus, even in case of a limited accidental movement of the handle, the slider will not be moved and there will be no action on the locking members whereby, in the engaged state, the male element will remain secured to the female element.

As more clearly explained in a few exemplary embodiments that will be illustrated hereinbelow, in a possible alternative embodiment, the device may be modified for the handle and the slider to be made of one piece.

Conversely, in the configuration in which the slider slides relative to the handle, for easier achievement of the unlocked state by intentional actuation of the handle, advantageously the handle of the inventive device of the present invention has a housing seat for the slider, which is formed in the thickness of the walls of the handle itself.

Furthermore, the housing seat has abutment surfaces for abutment of corresponding outer surfaces of the slider such that, from the locked state, any movement of the handle in a direction opposite to the direction of insertion will cause the abutment surfaces to abut the surfaces of the slider, thereby causing the slider to move in a direction opposite to the direction of insertion, from the locked state to the unlocked state.

As more clearly shown in the illustrated embodiments, the movement from the locked state to the unlocked state is always caused by the movement of the slider, but while the locked state is obtained by directly acting upon the slider, the unlocked state is obtained by an action on the handle, due to the provision of its abutment surfaces that cause the slider to move.

This feature is very important because, besides avoiding inadvertent movement of the slider into the locked state, it assists in pulling the male element out of the female element, for easier attainment of the unlocked state.

This is because the handle can be moved more easily than the slider, whereby the unlocked state is immediately attained even under poor visibility conditions, or when fine or accurate movements cannot be easily performed, as is often the case for scuba divers.

In a further improvement, the handle has a hole at the end opposite to the female element, such that the slider can be accessed from outside the handle.

As described below, this hole is disposed along a plane perpendicular to the longitudinal axis of the device.

Preferably, the actuation/release slider moves from a rearwardmost state, corresponding to the active unlocked state, to a forwardmost state, corresponding to the active locked state.

Furthermore, the actuation/release slider consists of an elongate element having an enlarged head at the end that faces the female element, such that as the enlarged head moves from the rearwardmost state to the forwardmost state, it presses the first locking members toward the inner walls of the female element, such that the first locking members engage with the second locking members located on the inner walls of the female element.

In a first embodiment of the above described configuration, when the slider is in its rearwardmost state, it projects out of the hole of the handle with the end opposite to the enlarged head.

This variant provides an immediate feedback about the position of the slider and hence about the state of the male element relative to the female element.

Thus, if the user sees a projecting slider, he readily understands that the slider is in the rearward state and the male element is not fixed to the female element.

If the slider is designed to have a color other than that of the handle, then an even clearer feedback will be obtained.

Alternatively, in the rearwardmost state the slider may have the end opposite to the enlarged head within the handle. The forwardmost state is thus attained by further pushing the slider inwards, i.e. in the direction of insertion of the male element into the female element.

Advantageously, the outer surface of this end may be designed to be flush with the outer surface of the handle.

This will further reduce the risk of accidentally triggering the forward movement of the slider.

In a further embodiment, at least one aperture may be provided, for indicating the rearwardmost state or the forwardmost state of the slider.

This variant is particularly advantageous in combination with the embodiment as described above in which the slider does not project out of the handle, as it still provides feedback about the position of the slider.

For instance, the state of the slider may be indicated by identification symbols, such that in the rearwardmost state the rearwardmost state identification symbol coincides with the aperture, and in the forwardmost state the aperture displays the corresponding symbol, thereby confirming that engagement has been actuated, and thus providing a very important feedback before starting the dive.

In a preferred embodiment, the two first locking members consist of two peripheral tongues.

Furthermore, the enlarged head has two head edges at each end, which are adapted to cooperate with corresponding end head edges of the end sections of the two tongues, with the head edges of the enlarged head acting as abutment surfaces for the head edges of the tongues, such that the two tongues are symmetrically pushed and held in a maximum spaced-apart relationship as the slider moves from the rearwardmost state to the forwardmost state.

Based on this feature, there may be various configurations of the part of the device that is designed to secure the male element to the female element, and some of these configurations will be described hereinbelow.

Regardless of the configuration in use, the mechanical parameters of the device of the present invention may be set to such values that the force required to actuate the forward movement of the slider (into the engaged state) is lower than the force required to actuate the rearward movement of the slider (into the disengaged state).

For example, there will be the possibility of using tongues and teeth formed with such shapes and materials as to generate little or no friction in the direction of insertion and much resistance and friction in the pull-out direction. This aspect is advantageous in that, as mentioned above, the rearward movement of the slider is facilitated by the handle, which will afford high stability in the engaged state of the male element and the female element, as well as easy attainment of the disengaged state of the male element and the female element.

Unlike prior art devices, this configuration provides mechanical actuation of the lock between the male element and the female element, as these two elements are locked together, to prevent mutual sliding thereof, by the first locking members being pushed and held by the slider against the second locking members, which will allow mutual engagement thereof.

Therefore, there will be no elastic actuation, which means that the lock is not obtained by a force generated by an elastic deformation that leads to connection between the teeth on the male element and corresponding seats on the female element, to thereby hold the male element against the female element, and the sealing action is not ensured only by the connection of the teeth and the seats, which would result in well-known disadvantages such as wear of the teeth and loss of elasticity of the material that forms the device and resulting deterioration of the sealing effect.

Mechanical actuation, as shown hereinafter in a few exemplary embodiments, is ensured by a mating form fit of the first locking members of the male element and the second locking members of the female element.

Furthermore, mechanical actuation ensures that no slack is present, i.e. that no undesired relative movement exists between the male element and the female element, which would be easily found in the case of elastic actuation.

In a further variant embodiment, the two tongues have an outer tapered lead-in end section, preferably curved, and the enlarged head of the slider has a curved surface, on the outer side facing toward the female element, which is connected to the two end sections of the tongues in the forwardmost state of the slider, thereby forming a seamless surface therewith.

The surface formed by the enlarged head and the tongues further facilitates insertion of the male element into the female element, as it is a seamless curved lead-in surface, which does not necessarily require alignment of the male element and the female element along the longitudinal axis, but does not allow insertion of the one into the other in an off-alignment state.

In a further embodiment, the slider is provided at the longitudinal axis of the male element, whereas the first locking members are placed at the sides of the slider, and each have a first engagement tooth which connects to a corresponding second engagement tooth on the inner walls of the female element.

According to an improvement of the above described variant of the two locking members consists of a rigid element. These rigid elements are in a stable maximum close-together relationship when the slider is in the rearwardmost state, whereas the two rigid elements are in a maximum spaced-apart relationship when the slider is the forwardmost state.

According to one embodiment, the two first locking members consist of two peripheral tongues, which have an outer tapered lead-in end section, preferably curved.

At a given distance from the end section, each tongue has a first engagement tooth formed by a recess in the tongue, which is located at the connection area with the substantially longitudinal straight section of the tongue.

Furthermore, the enlarged head of the slider has a curved surface, on the outer side facing toward the female element, which is connected to the two end sections of the tongues in the forwardmost state of the slider, thereby forming a seamless surface therewith.

The enlarged head finally has two head edges at each end, which are adapted to cooperate with corresponding end head edges of the end sections of the two tongues, with the head edges of the enlarged head acting as abutment surfaces for the head edges of the tongues, such that the two tongues are symmetrically pushed and held in the maximum spaced-apart relationship as the slider moves from the rearwardmost state to the forwardmost state.

According to a further embodiment of the locking/unlocking mechanism of the device of the present invention, the enlarged head has two extensions, which are inclined to the axis of insertion, and form guide wings cooperating with stop wings.

Each tongue has a stop wing, which extends with a given inclination toward the guide wings, such that the guide wings and the stop wings may cooperate to ensure that the wings are spaced apart as the slider moves forward and that the wings are drawn close together as the slider moves rearward, thereby ensuring locking engagement or disengagement in response to a push or pull action on the slider.

According to a further embodiment, that will appear more clearly from a few exemplary embodiments, the enlarged head has two grooves inclined to the sliding axis of the slider, which are adapted to cooperate with the tongues to drive the two tongues outwards as the slider moves from the rearwardmost state to the forwardmost state and inwards as the slider moves from the forwardmost state to the rearwardmost state, such that the two tongues are symmetrically pushed and held in a maximum spaced-apart relationship as the slider moves from the rearwardmost state to the forwardmost state and such that the two tongues are symmetrically pulled and held in a maximum close-together relationship as the slider moves from the forwardmost state to the rearwardmost state.

As mentioned above, the above described characteristics are even more advantageous if the device of the present invention is used in combination with a diving jacket.

Therefore, advantageously the first element is a weight pocket, and the second element is at least part of a diving jacket.

Preferably, the male element has fixation members for fixation of said weight pocket.

In the particular case in which the device of the present invention is used for scuba diving, it will be apparent that as the handle is pulled, the ballast envelope is pulled out of its housing in the jacket.

Thus, the unlocked state is part of the movement for removing the ballast envelope. In an emergency or during doffing, the handle is pulled by actuating the slider to remove the ballast.

As the slider is pulled into the unlocked state, the buckle, which is joined to the male element and is connected to the weight envelope, is released for the weight envelope to be pulled out.

Therefore, the envelope is easily pulled out, without requiring the diver to take particular care of the operations he/she has to carry out, which is a particular important feature under emergency/panic conditions.

Since the unlocked state is only attained by a pull action on the handle, this will prevent any accidental drop of the weight envelope, which would cause an uncontrolled ascent of the diver with possible consequences such as embolism or decompression sickness.

It should be understood that the inventive principle of the present device is not limited to the provision of a weight pocket and extends well beyond the scuba diving field.

As more clearly shown by the embodiments as described below, the device of the present invention may be used, for instance, in the automotive field, as an emergency arrangement for unfastening seat belts after an accident, e.g. if the normal unfastening button cannot be easily accessed.

It will be appreciated from the following description and from the figures that the variant embodiments suggested herein improve the stability of the locked and unlocked states, afford easier insertion of the male element into the female element and optimize handleability of the whole device.

Finally, the present invention relates to a reversible connection device for reversibly connecting together a first element and a second element, said elements being designed to be alternately connected to and disconnected from each other.

The device comprises a male element, designed to be connected to one end of the first element, and which is inserted into a female element, designed to be connected to one end of the second element, such that the male element and the female element move from a mutually disengaged state to a mutually engaged state.

A slider is also provided, for actuation/release of the engaged state, which is slidingly engaged by the male element along the axis of insertion of the male element into the female element.

The relative movement of the slider and the male element is transferred to first releasable locking members of the male element, which cooperate with corresponding locking members of the female element to move from a stable locked state to a stable unlocked state of the male element relative to the female element.

The movement from the unlocked state to the locked state is obtained by an action of movement of the slider in the direction of insertion.

The actuation/release slider moves from the rearwardmost state, corresponding to the active unlocked state, to a forwardmost state, corresponding to the active locked state.

Furthermore, the actuation/release slider consists of an elongate element having an enlarged head at the end that faces the female element, such that as the enlarged head moves from the rearwardmost state to the forwardmost state, it presses the first locking members toward the inner walls of the female element, such that the first locking members engage with the second locking members located on the inner walls of the female element.

The above described device may include one or more of the above described features.

These and other features and advantages of the present invention will appear more clearly from the following description of a few embodiments, illustrated in the annexed drawings, in which:

FIGS. 1*a* to 1*c* show three different views of the device of the present invention, according to a possible embodiment;

FIGS. 1*d* to 1*f* show the system of the present invention according to a possible embodiment;

FIGS. 1*g* to 1*h* show the device of the present invention according to a further embodiment;

FIGS. 1*i* and 1*l* show a further variant embodiment of the device of the present invention;

FIGS. 2*a* to 2*d* show four different views of the device of the present invention, according to a further embodiment;

FIG. 3 shows a perspective view of the reversible connection device of the present invention;

FIGS. 4*a* and 4*b* show two sections of the device of the present invention with the male element inserted in the female element, in the unlocked and locked states respectively;

FIGS. 5*a* and 5*b* show the male element of the device of the present invention with the slider in the rearwardmost state and in the forwardmost state respectively;

FIGS. 6*a* and 6*b* show two sections as taken along the transverse plane and the longitudinal plane of a perspective view of the male element of the device of the present invention;

Figure 9B:
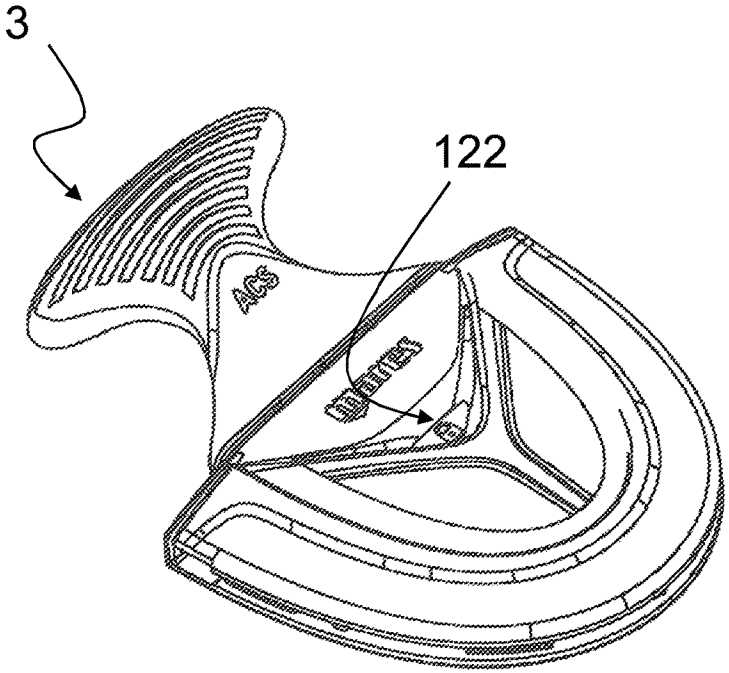
Figure 9A:
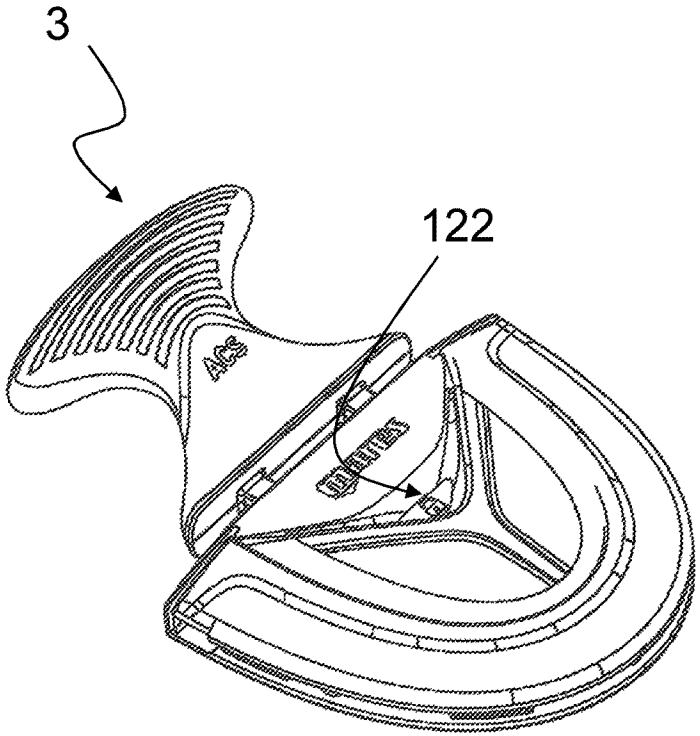
Figure 10A:
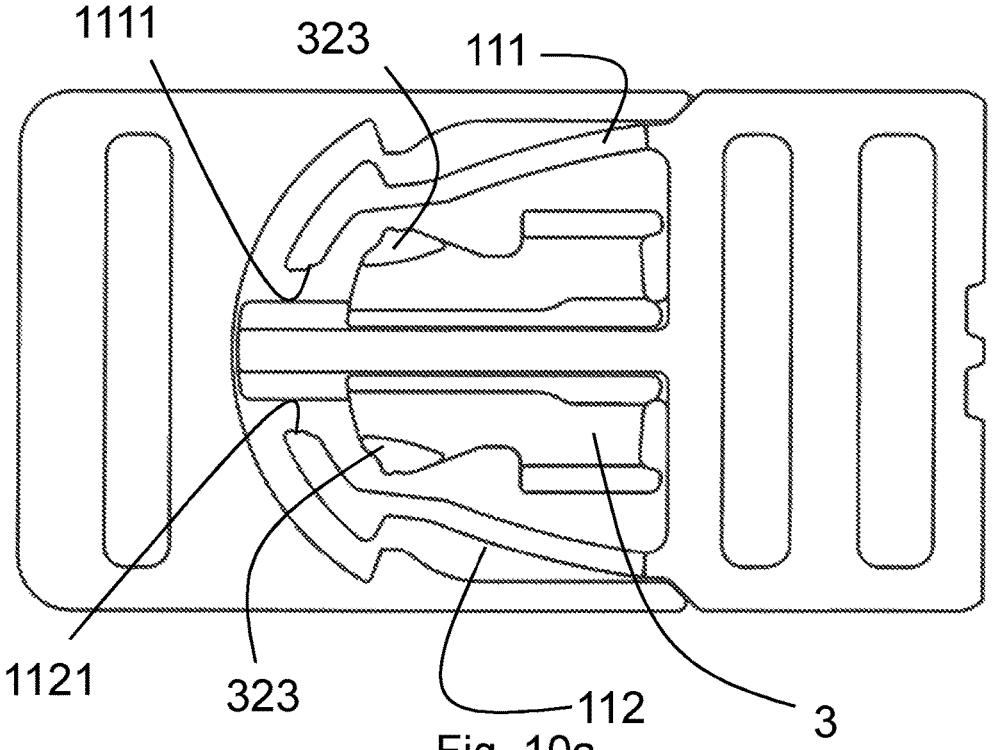
Figure 10B:
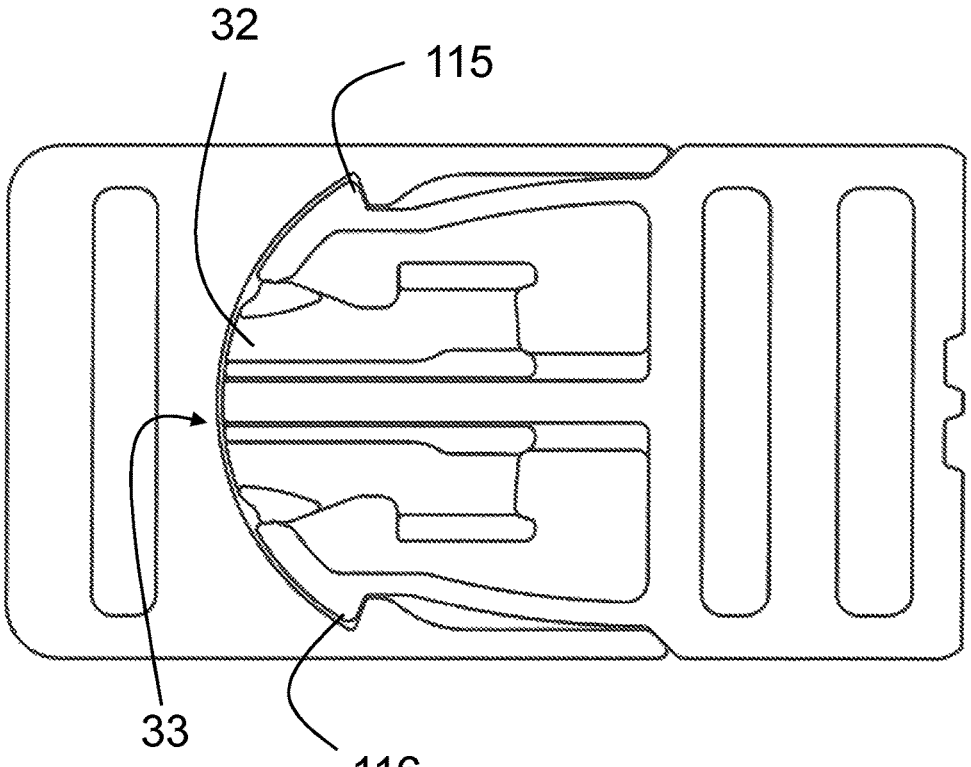
Figure 11A:
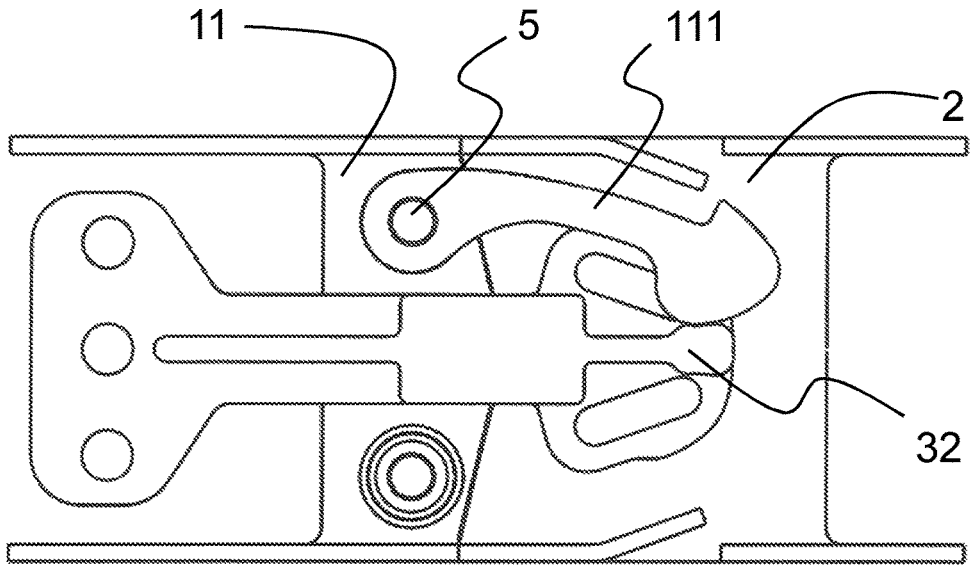
Figure 11B:
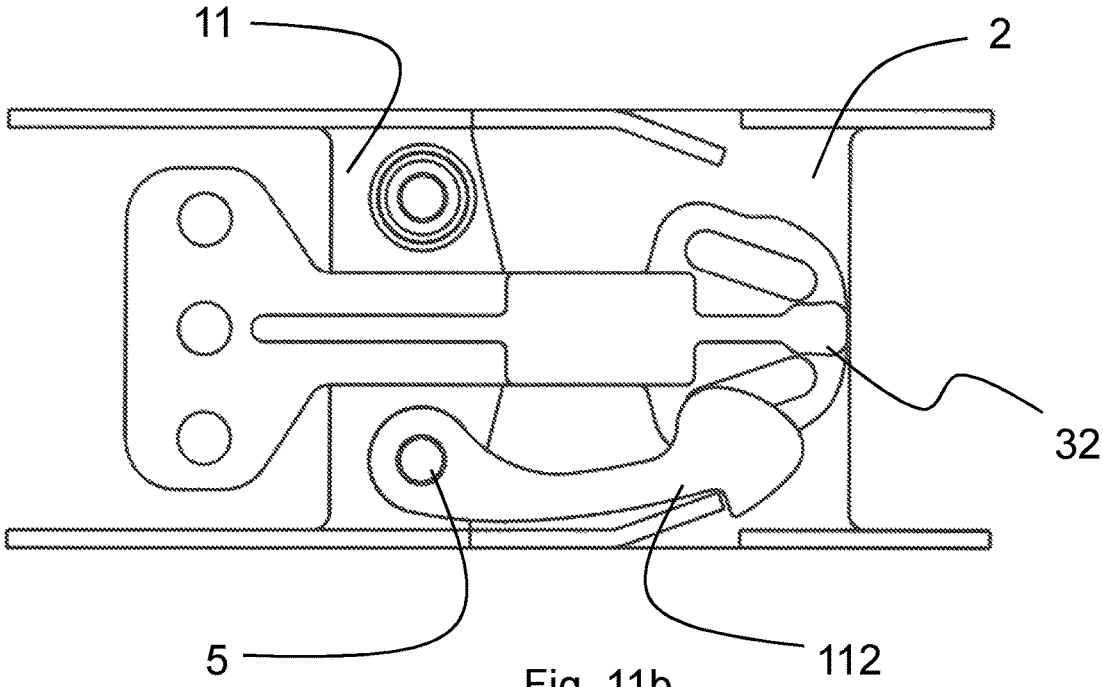
Figure 11C:
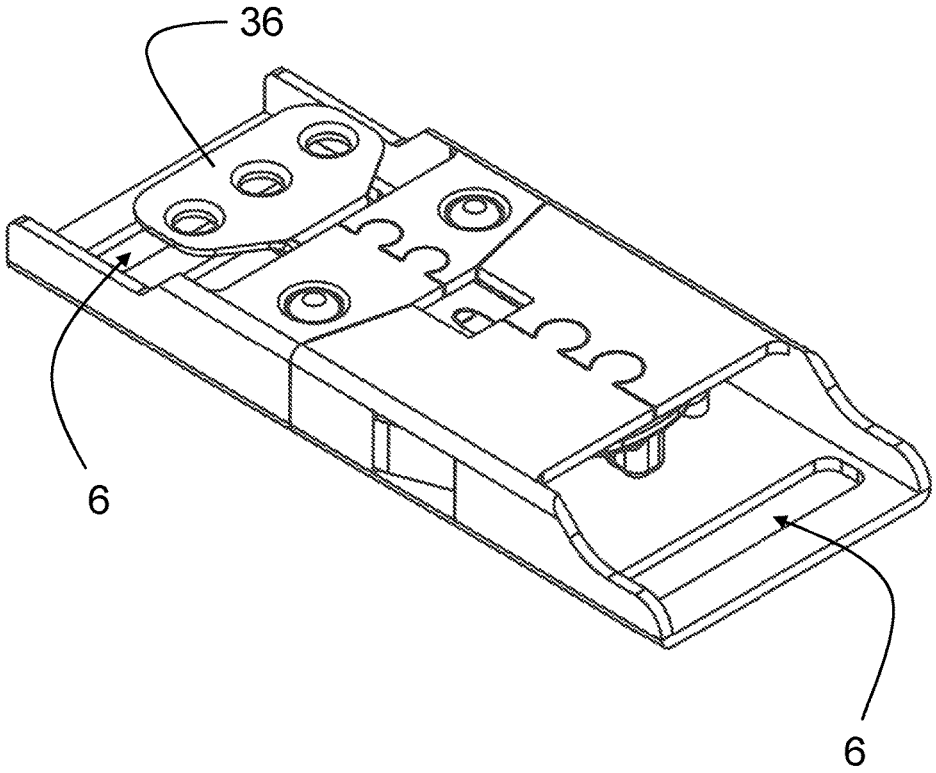

FIGS. 9*a* and 9*b* show a top view of the device of the present invention, in the unlocked and locked states respectively;

FIGS. 10*a* and 10*b* show two sections of the device of the present invention with the male element inserted in the female element, in the unlocked and locked states respectively;

FIGS. 11*a* to 11*c* show a further variant embodiment of the device of the present invention.

It shall be understood that the variant embodiments as shown in the accompanying drawings are only proposed by way of illustration and for a better understanding of the principles and advantages of the device of the present invention, and shall not be intended to limit the inventive principle of the present patent application, i.e. to provide a reversible connection device that affords easy and efficient engagement/disengagement of the male element with/from the female element, i.e. the two elements that compose the device of the present invention.

Particularly referring to FIGS. 1*a* to 2*d*, the device of the present invention is a reversible connection device for reversibly connecting together a first element and a second element, said elements being designed to be alternately connected to and disconnected from each other.

Figure 3:
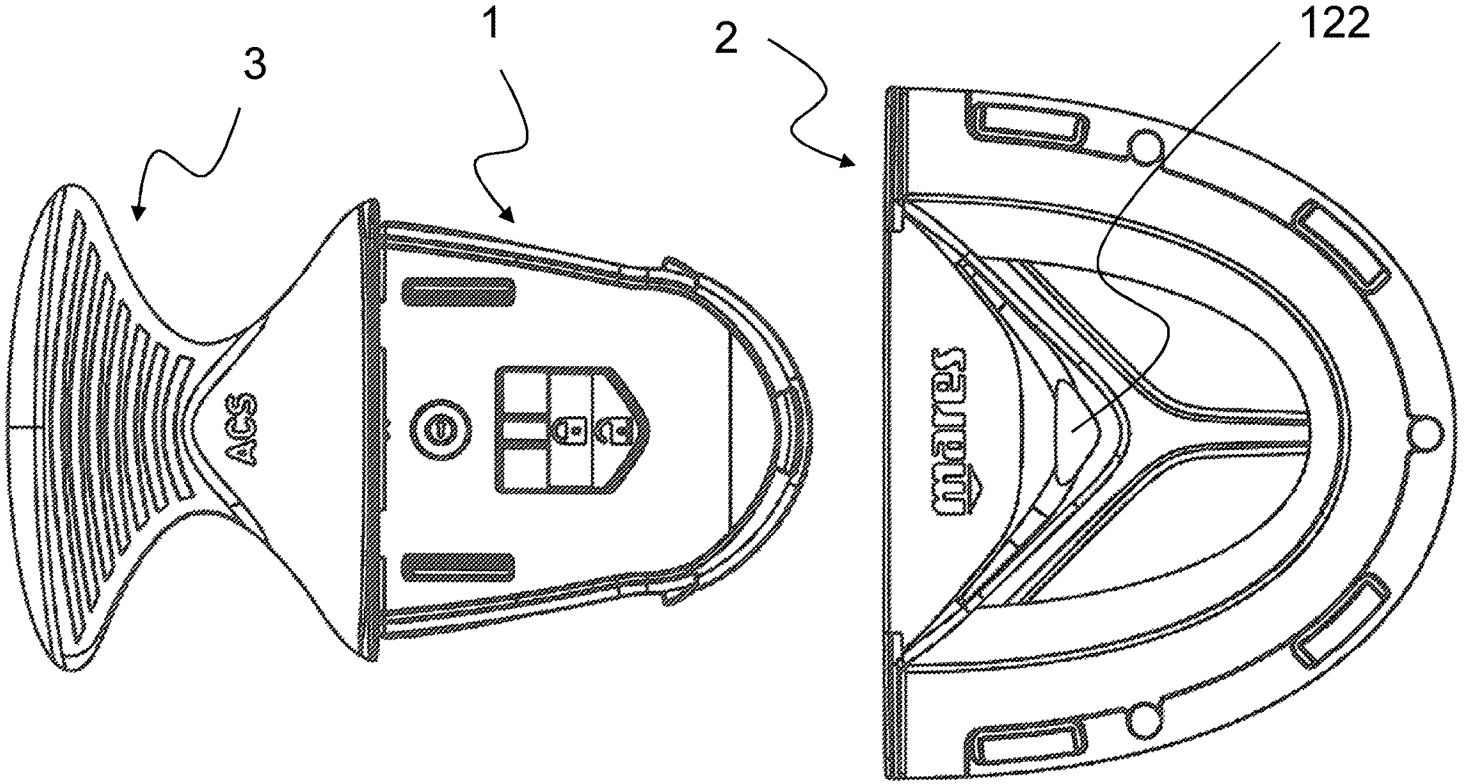

The device comprises a male element 1, designed to be connected to one end of the first element, which male element 1 is inserted into a female element 2, designed to be connected to one end of the second element, such that the male element 1 and the female element 2 move from a mutually disengaged state, as shown in FIG. 3, to a mutually engaged state, as shown in FIGS. 1*a*, 1*f*, 1*h* and 2*a*.

The device further comprises a slider 3 for actuation/release of the engaged state, which is slidingly engaged by the male element 1 along the axis of insertion of the male element 1 into the female element 2.

The relative movement of the actuation/release slider 3 and the male element 1 is transferred to first releasable locking members of the male element 1, which cooperate with corresponding second locking members of the female element 2 to move from a stable locked state to a stable unlocked state of the male element 1 relative to the female element 2.

Particularly, the movement from the unlocked state to the locked state is obtained by an action of movement of the slider 3 in the direction of insertion.

Figure 1A:
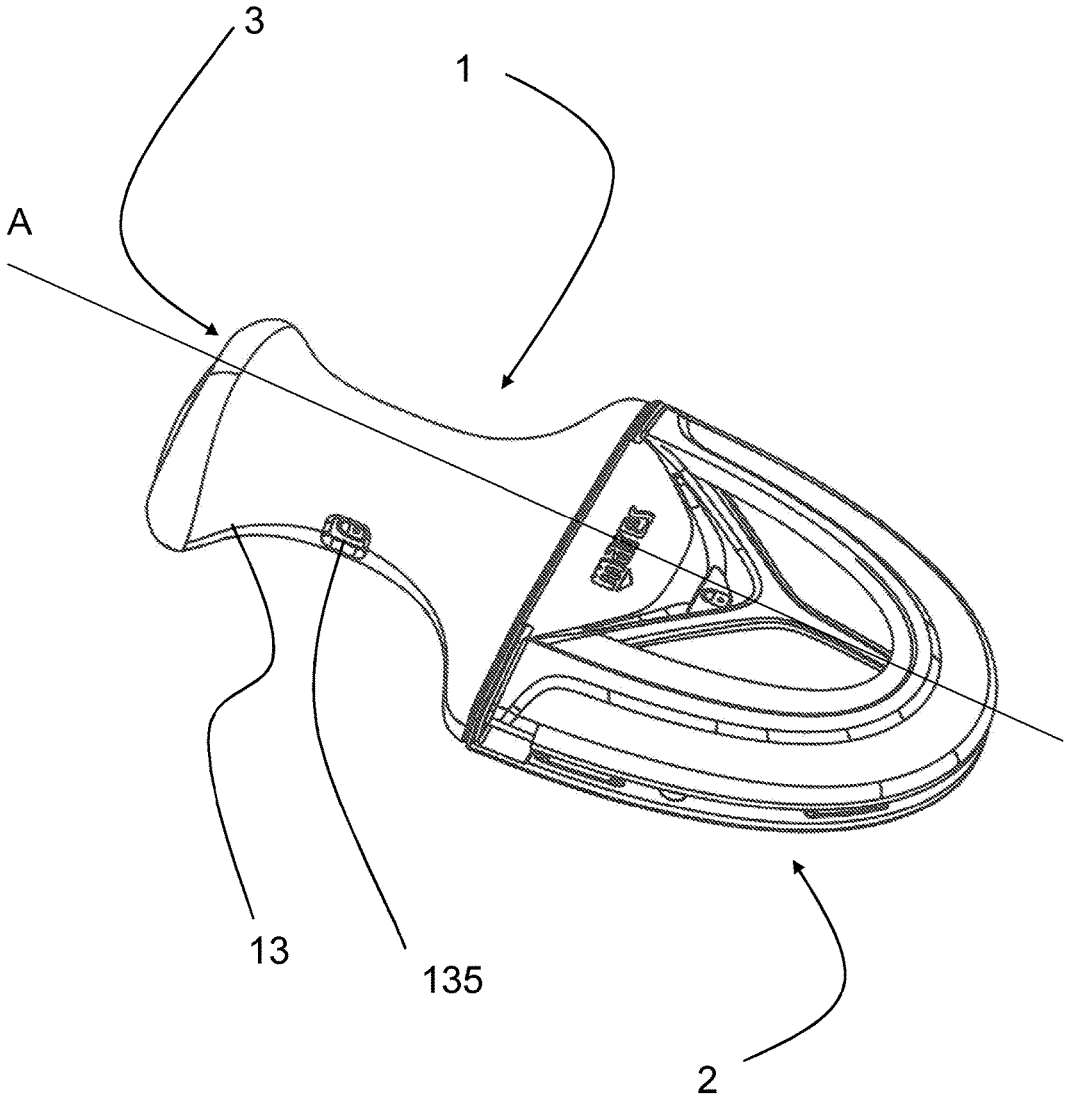

It shall be noted that the male element is inserted into the female element in the direction of the longitudinal axis A as shown in FIG. 1*a*.

Particularly, the male element 1 comprises a handle 13 having the slider 3 at least partially and slidingly housed therein.

Thus, the slider 3 is disengaged from the handle 13.

FIGS. 3 to 11*c* show a few variant embodiments which intend to describe the interactions between the slider and the locking members, whereas FIGS. 1*a* to 2*d* show a few embodiments of the part of the inventive device that is designed to be held by a user to move the slider 3.

Particularly referring to FIGS. 1*a* to 1*c*, the slider 3 is shown within the handle 13, such that it may slide in the direction of axis A, FIG. 1*b*, to push, as described below, the first locking members for engagement of the male element 1 with the female elements 2.

Particularly if the slider 3 is pushed toward the female element 2 along axis A, it will actuate the locked state, whereas if it is pushed along axis A away from the female element 2, it will actuate the unlocked state.

According to the variant embodiment as shown in the figures, the handle 13 has a housing seat 131 for the slider 3, which is formed in the thickness of the walls of the handle 13.

Furthermore, the housing seat 131 has abutment surfaces 132 for abutment of corresponding outer surfaces 37 of the slider 3 such that, from the locked state, any movement of the handle 13 in a direction opposite to the direction of insertion will cause the abutment surfaces 132 to abut against the surfaces 37 of the slider 3, thereby causing the slider 3 to move in a direction opposite to the direction of insertion, from the locked state to the unlocked state.

As shown in the figures, in order to actuate the locked state, the slider 3 is pushed toward the female element 2, whereas in order to actuate the unlocked state, the handle 13 may be pushed away from the female element 2: as soon as the abutment surfaces 132 contact the surfaces 37 of the slider 3, the slider 3 is pulled rearwards with the handle and actuates the unlocked state.

It shall be noted that the abutment surfaces may be located at any point of the housing seat 131.

A variant embodiment showing a different position of the abutment surfaces is shown in FIGS. 1*d* to 1*h*.

In the variant as shown in FIGS. 1*d* to 1*h*, the abutment surfaces 37 of the slider 3 are located at the end of the slider 3 opposite to the female element 2, such that they may cooperate with corresponding surfaces 132 of the housing seat 131 formed within the handle 13. Advantageously, the handle 13 has a hole 133 at the end opposite to the female element 2, such that the slider 3 can be accessed from outside the handle 13.

Figure 1B:
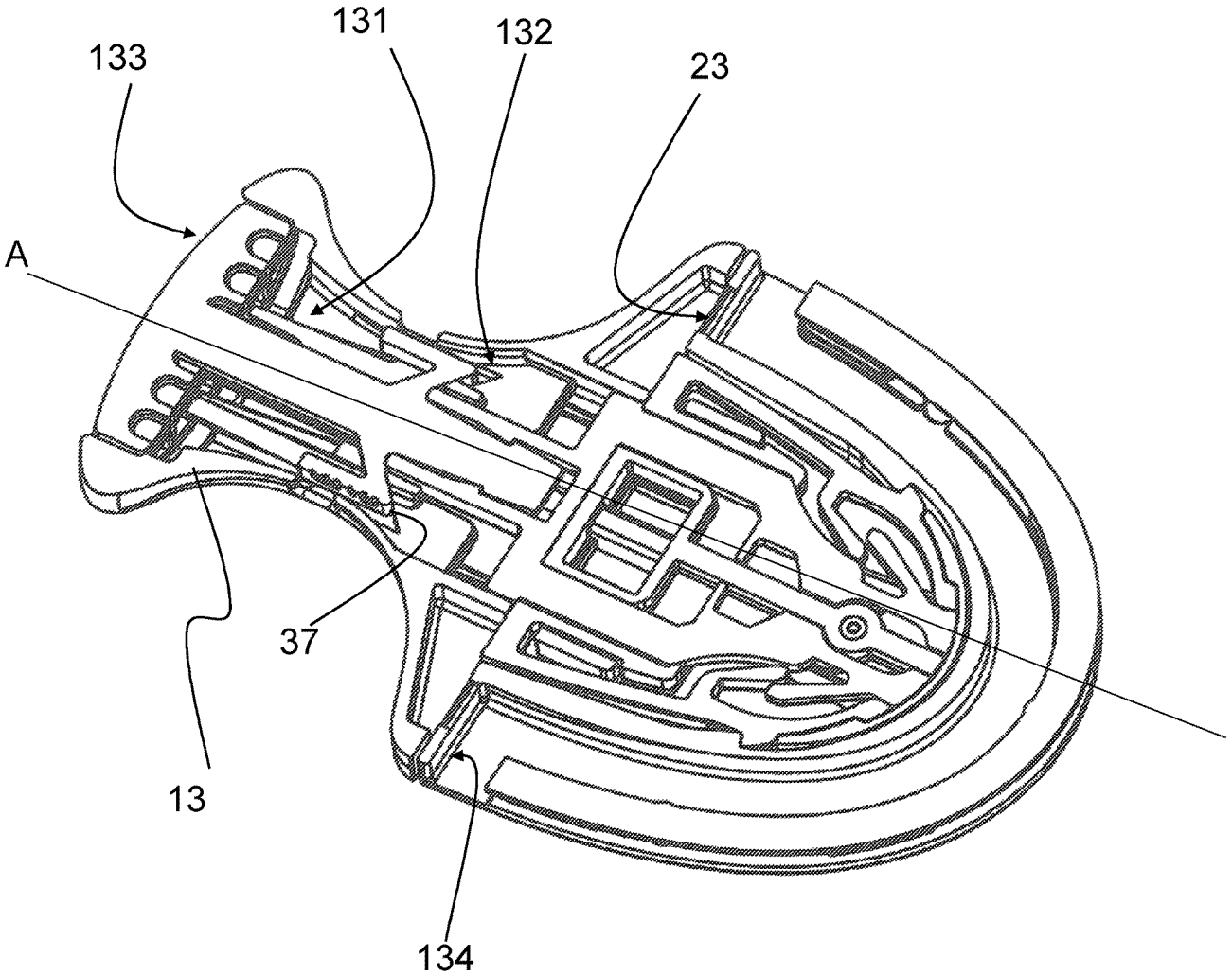
Figure 1C:
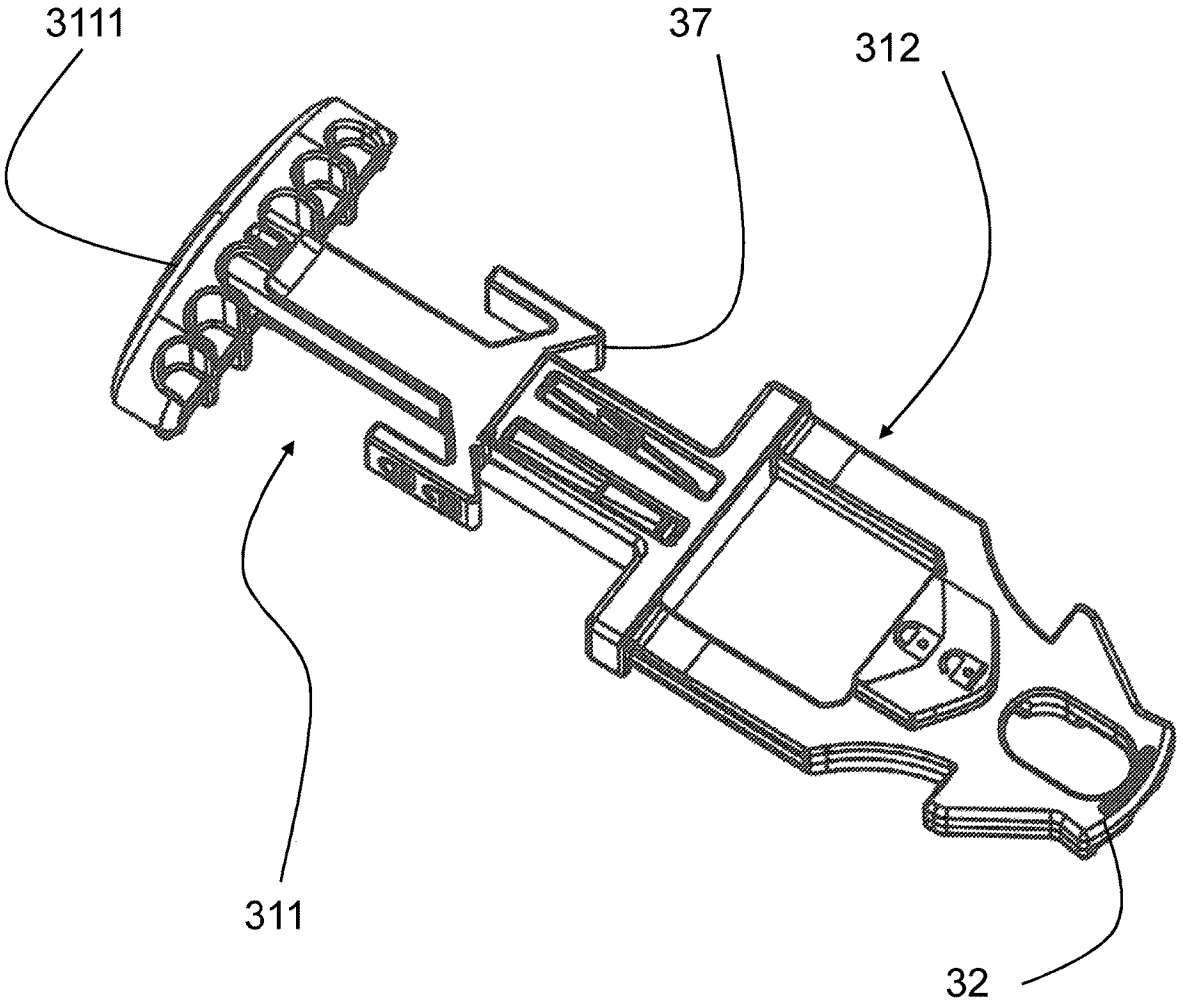
Figure 1D:
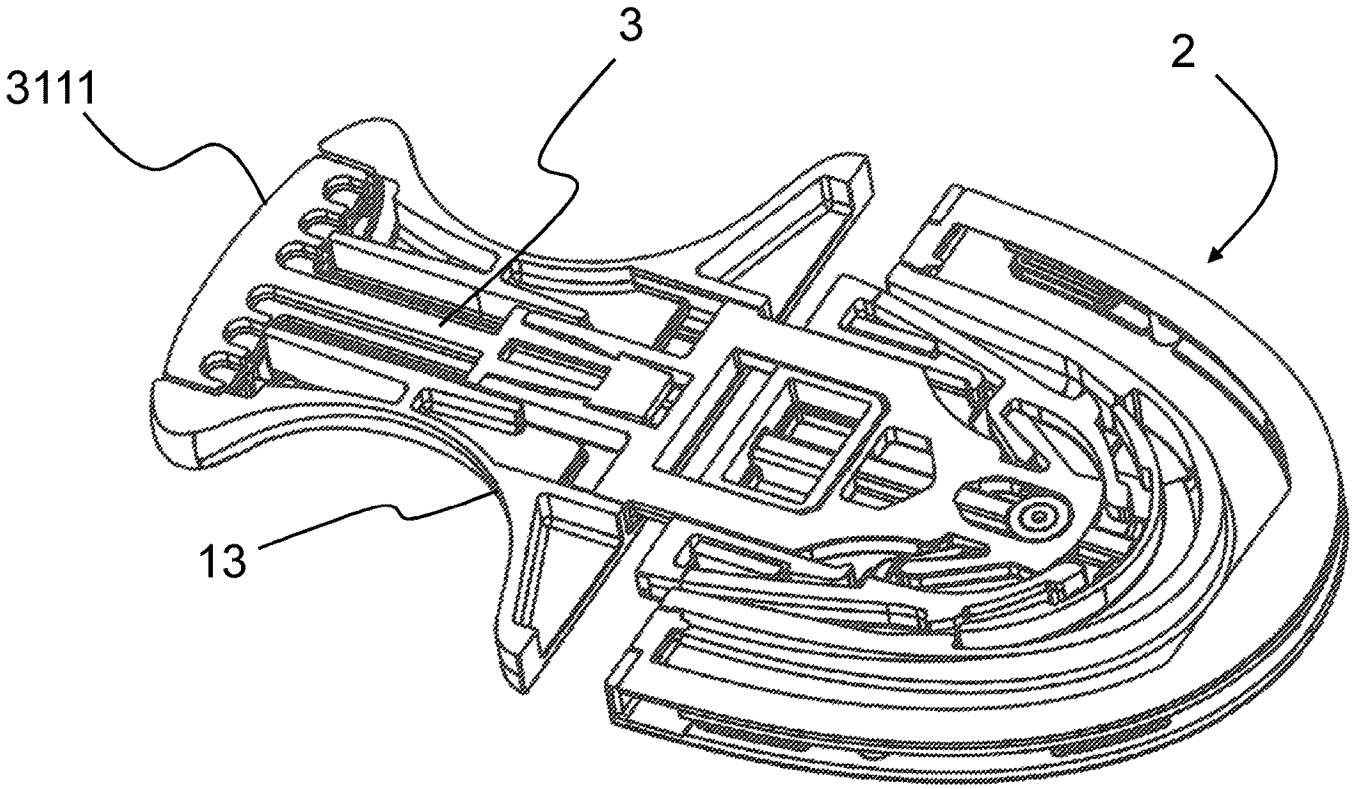
Figure 1E:
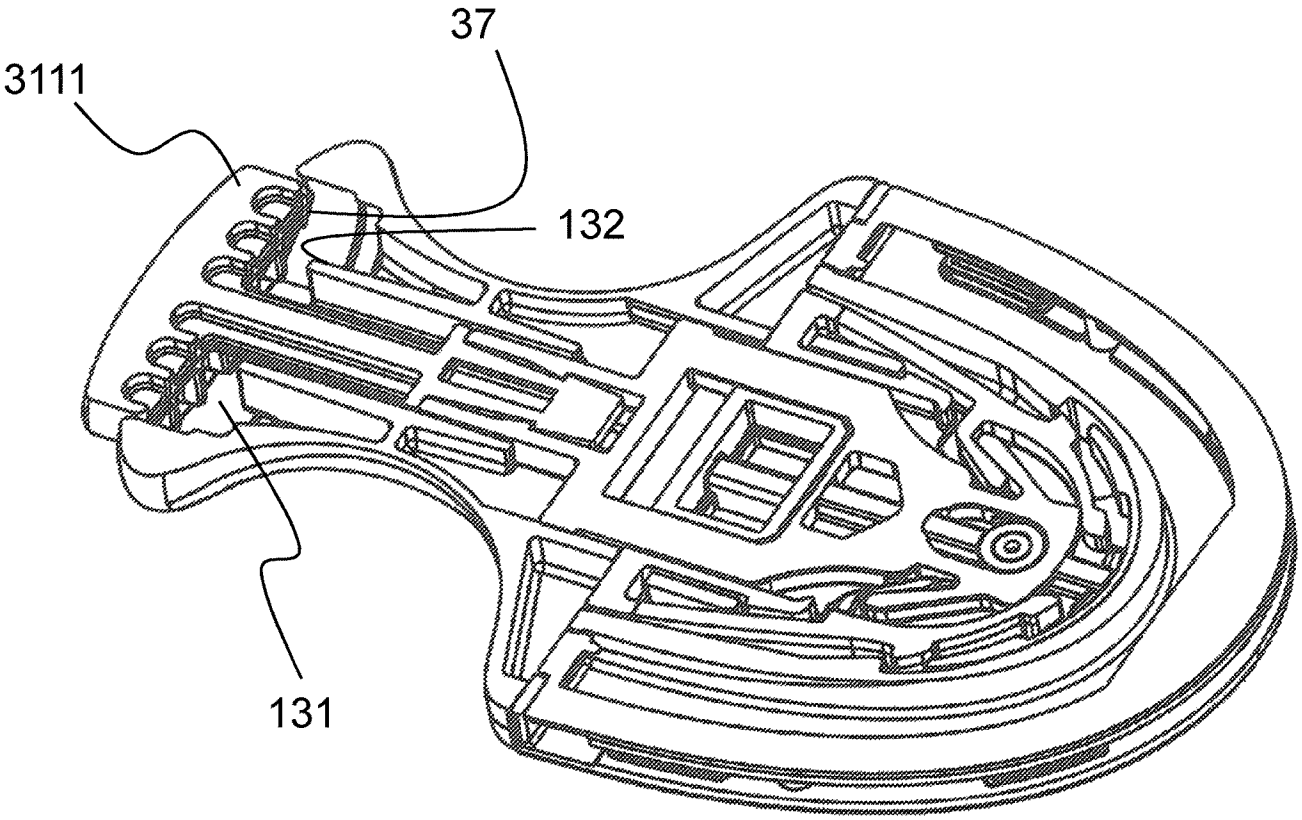
Figure 1F:
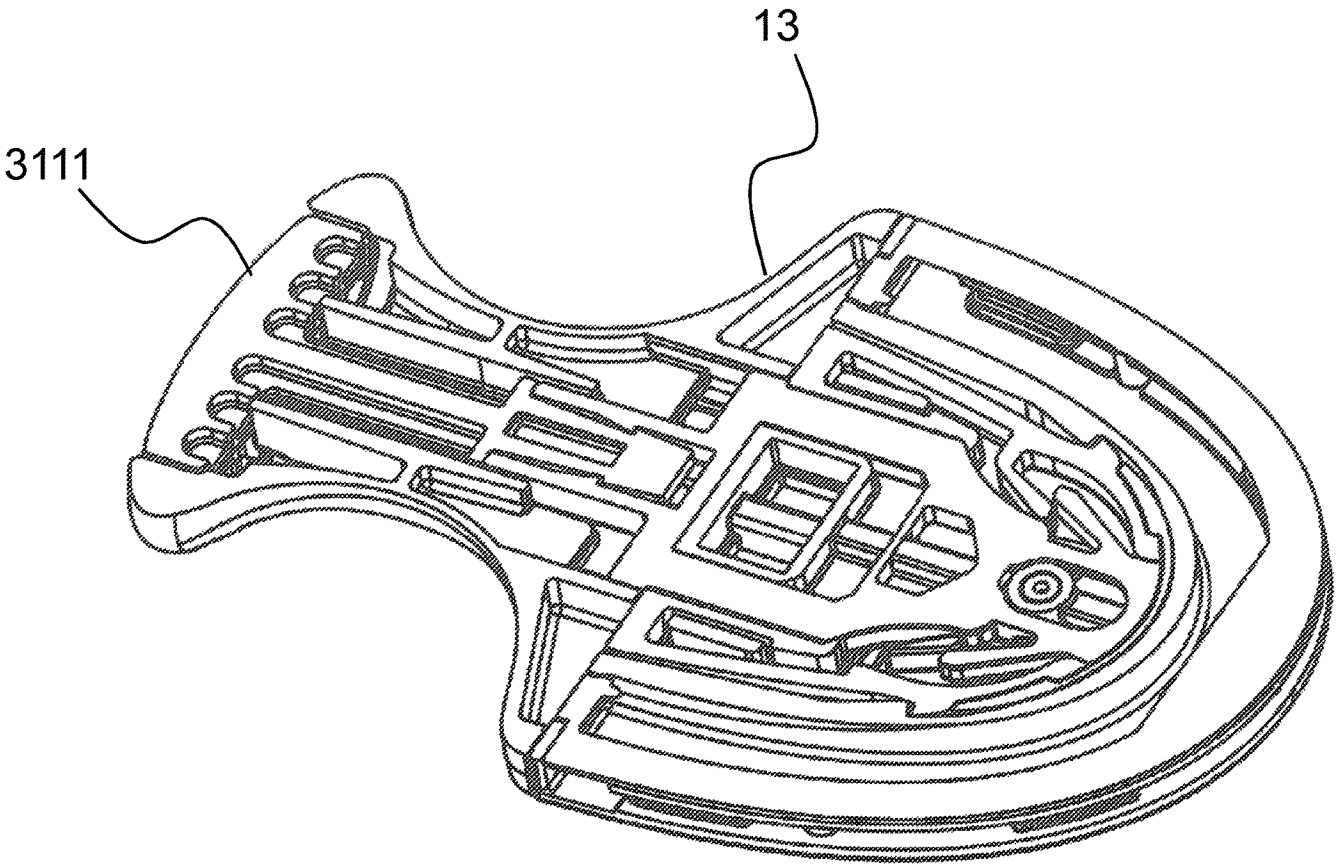
Figure 1G:
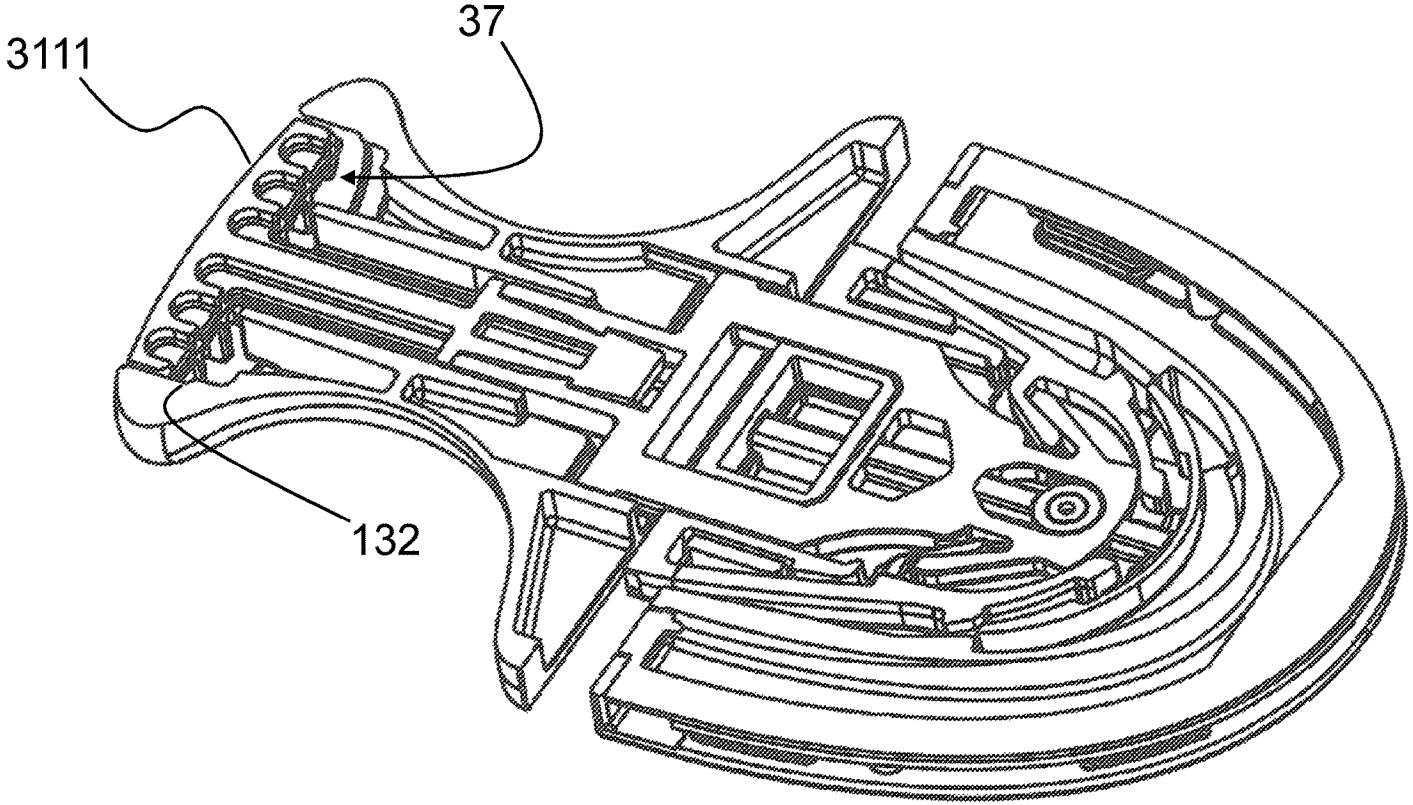

As shown in the figures, particularly FIGS. 1*b*, 1*e* and 1*g*, any user may press the slider 3 and act thereupon due to the presence of hole 133 of the handle 13.

Furthermore, according to an improvement, the actuation/release slider 3 moves from a rearwardmost state, corresponding to the active unlocked state, to a forwardmost state, corresponding to the active locked state.

Furthermore, particularly referring to FIG. 1*c*, the actuation/release slider consists of an elongate element 31 having an enlarged head 32 at the end that faces the female element 2, such that as the enlarged head 32 moves from the rearwardmost state to the forwardmost state, it presses the first locking members toward the inner walls of the female element 2, such that the first locking members engage with the second locking members located on the inner walls of the female element 2.

Particularly referring to FIG. 1*c*, the elongate element 32 is composed of two parts, i.e. a first part 311 and a second part 312.

The first part 311 engages with the second part 312.

Furthermore, the first part 311 has the end 3111 upon which a force is exerted to push the slider 3 forward, and has the surfaces 37 for abutment against the abutment surfaces 132 of the housing seat 131.

On the other hand, the second part 312 has the enlarged head 32.

In a possible embodiment, the first part 311 and the second part 312 may be formed of one piece.

Based on the features as described above and particularly referring to FIGS. 1*a* to 2*d*, the operation of the device of the present invention will be described below.

Once the male element 1 has been inserted into the female element 2, the male element 1 will about the inner walls of the female element 2, whereas the slider 3 will be in its rearwardmost state.

Particularly, at least the surfaces 134 of the handle 13 will about the walls 23 of the female element 2.

The locked state is not active yet, whereby the slider 3 is pushed along axis A toward the female element 2, into the forwardmost state.

The male element 1 and particularly the handle 13 are stationary, and the slider 3 only moves, with the enlarged head 32 pushing the first locking members, which will actuate the locked state.

Once the male element 1 is engaged with the female element 2, the handle 13 is pulled away from the female element 2, the abutment surfaces 132 contact the surfaces 37, and the slider 3 is pushed in the same direction as the handle 13 and actuates the unlocked state.

Particularly, FIGS. 1*d* to 1*f* show how the male element 1 is inserted into the female element 2.

In FIG. 1*d* the male element 1 and the female element 2 are not engaged with each other and the slider 3 is in the rearwardmost state.

In FIG. 1*e* the male element is pushed toward the female element in the direction of insertion, but the male element is not engaged with the female element yet, as the slider 3 is still in the rearwardmost state.

Then, the slider 3 is pushed toward the female element 2, slides within the handle 13 and moves the first locking members for the male element 1 to engage with the female element 2, as shown in FIG. 1*f*.

From the forwardmost state, as shown in FIG. 1*f*, by an action on the handle 13, which is pulled away from the female element 2, the abutment surfaces 132 of the housing seat 131 which abut the surfaces 37 of the slider push the slider to the rearwardmost state, thereby releasing the male element 1 from the female element 2.

According to a possible embodiment, when the slider 3 is in its rearwardmost state, it may project out of the hole 133 of the handle 13 with the end 3111 opposite to the enlarged head 32, as shown in FIG. 1*e*.

Figure 1H:
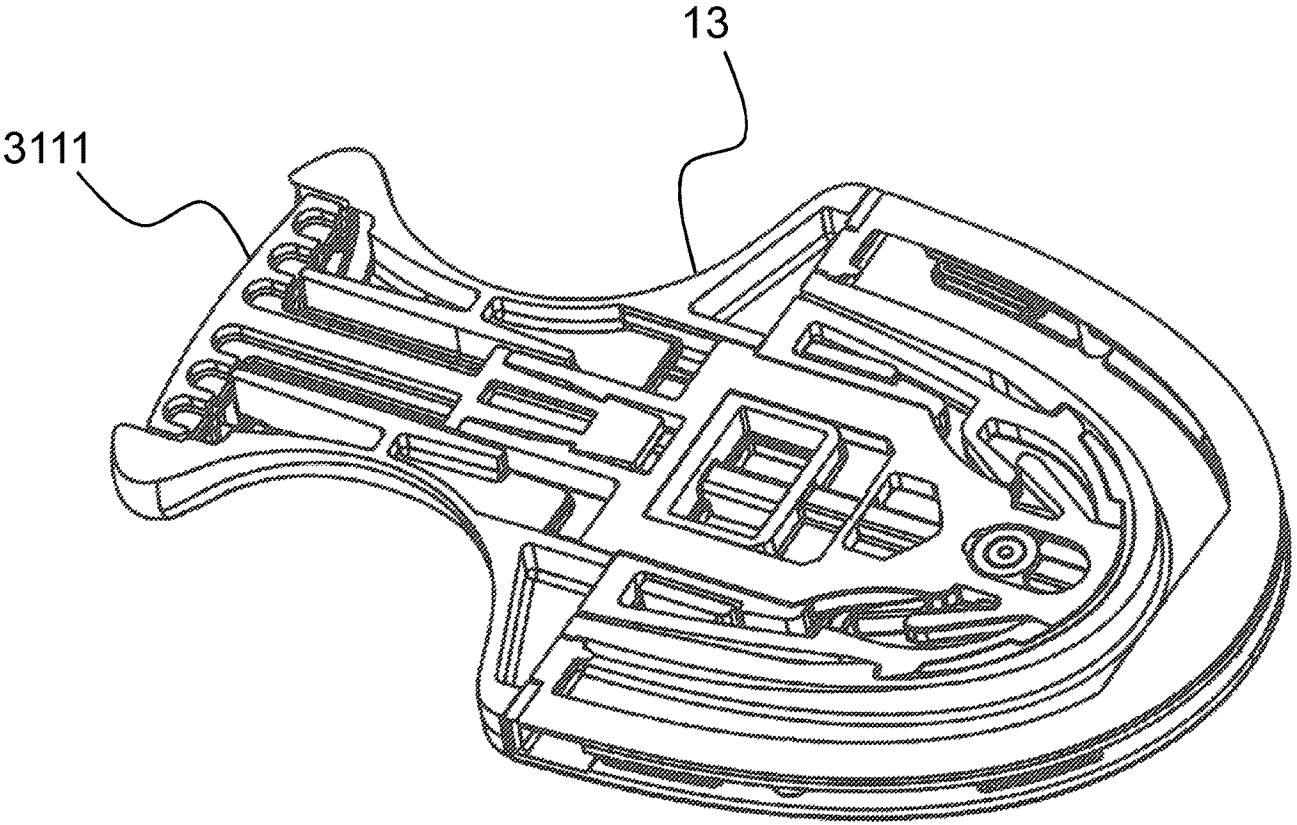

Alternatively, when the slider 3 is in its forwardmost state, it has the end 3111 opposite to the enlarged head 32 within the handle 13, as shown in FIG. 1*h*.

According to an improvement as shown in FIGS. 1*a* and 1*b*, the handle 13 may have at least one aperture 135, for indicating the rearwardmost state or the forwardmost state of the slider 3.

According to a possible modified feature of the device of the present invention, the handle 13 and the slider 3 are formed of one piece.

It shall be noted that this particular configuration does not change the operation of the device of the present invention, and especially the interaction between the enlarged head 32 of the slider 3 and the first locking means of the male element 1 is unchanged.

This arrangement is shown in FIGS. 1*i*, 1*l*, 5*a* and 5*b*.

Figure 1I:
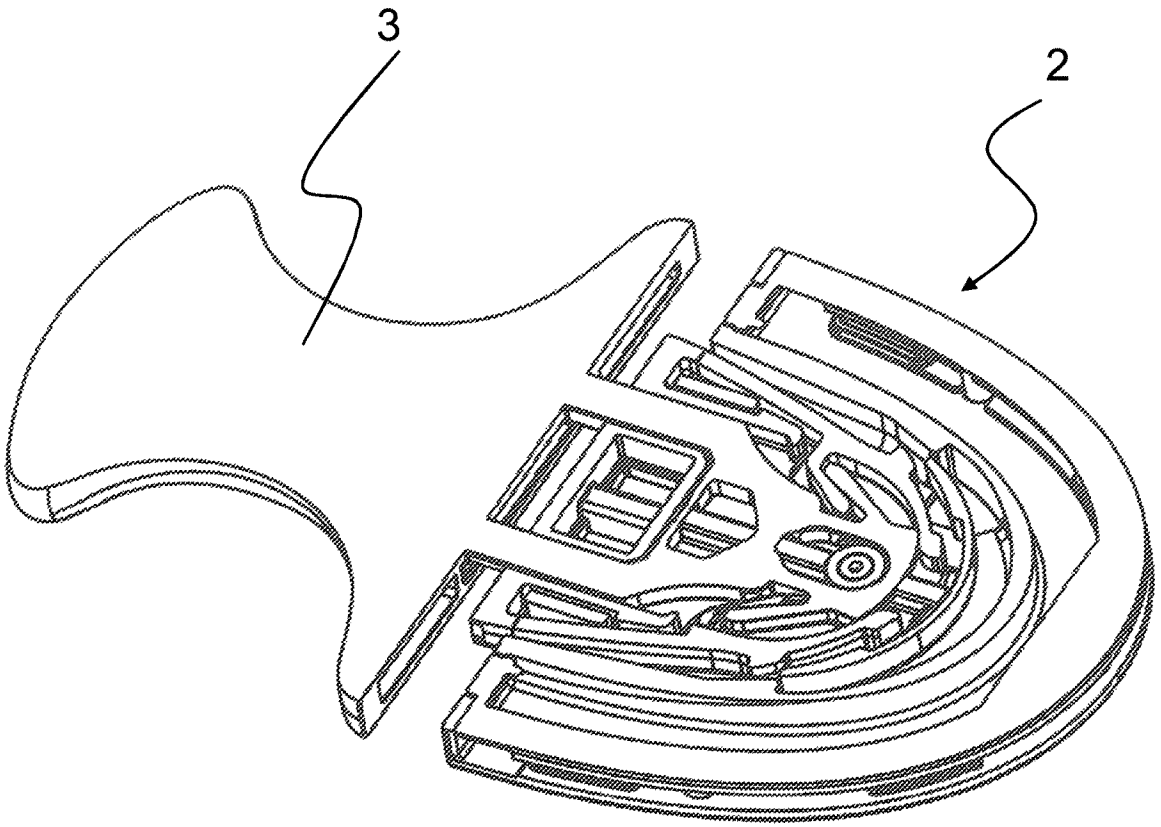
Figure 1I:
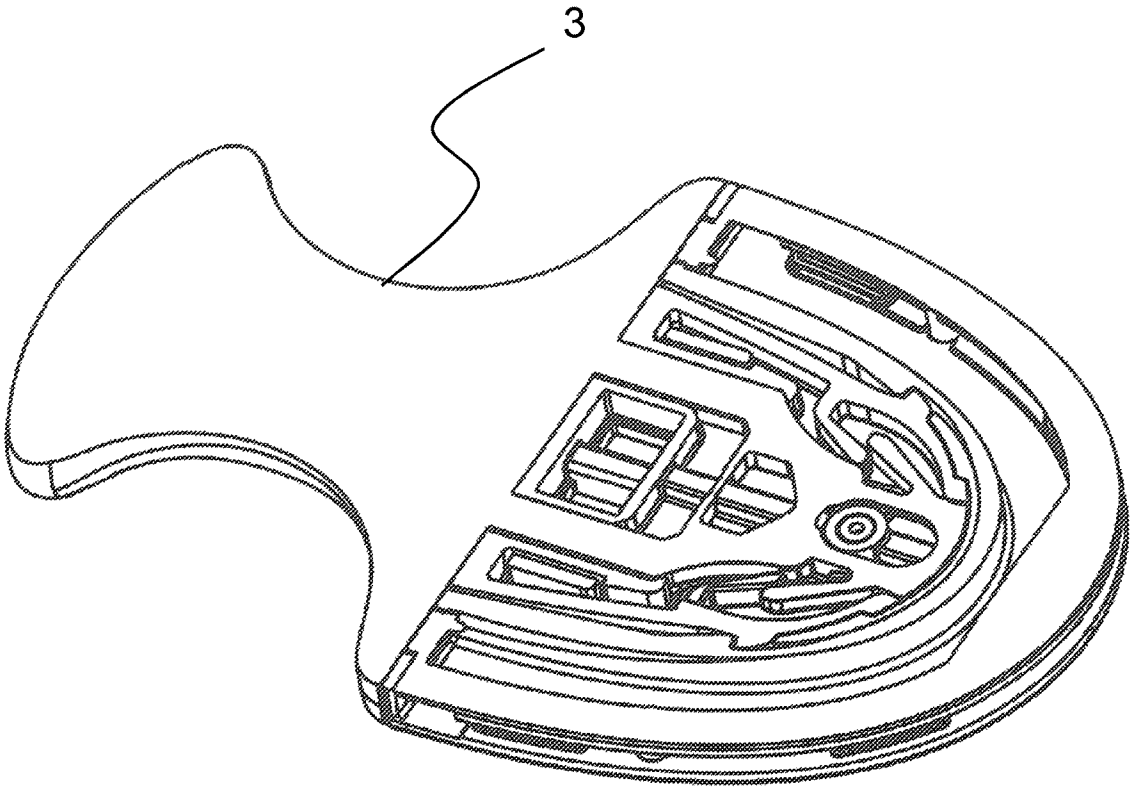

Particularly, FIG. 1*i* shows the device of the present invention in which the male element 1 and the female element 2 are not engaged with each other, whereas FIG. 1*l* shows the locked state, in which the male element 1 is engaged with the female element 2.

FIGS. 2*a* to 2*d* show an embodiment of the device of the present invention.

This embodiment includes all the features as described above with reference to FIGS. 1*a* to 1*l*, and has the same operation.

The embodiment as shown in FIGS. 2*a* to 2*d* features a different design of the slider 3, particularly its enlarged head 32, as well as a different arrangement for fixation of the male element 1 to the first element.

These differences will be expressly described below with the help of the description of FIGS. 2 to 11*c*.

As mentioned above, FIGS. 3 to 11*c* have the purpose of illustrating the operation of the device of the present invention, particularly referring to the interaction between the slider 3, namely its enlarged head 32, the locking members of the male element 1 and the locking members of the female element 2.

Figure 4A:
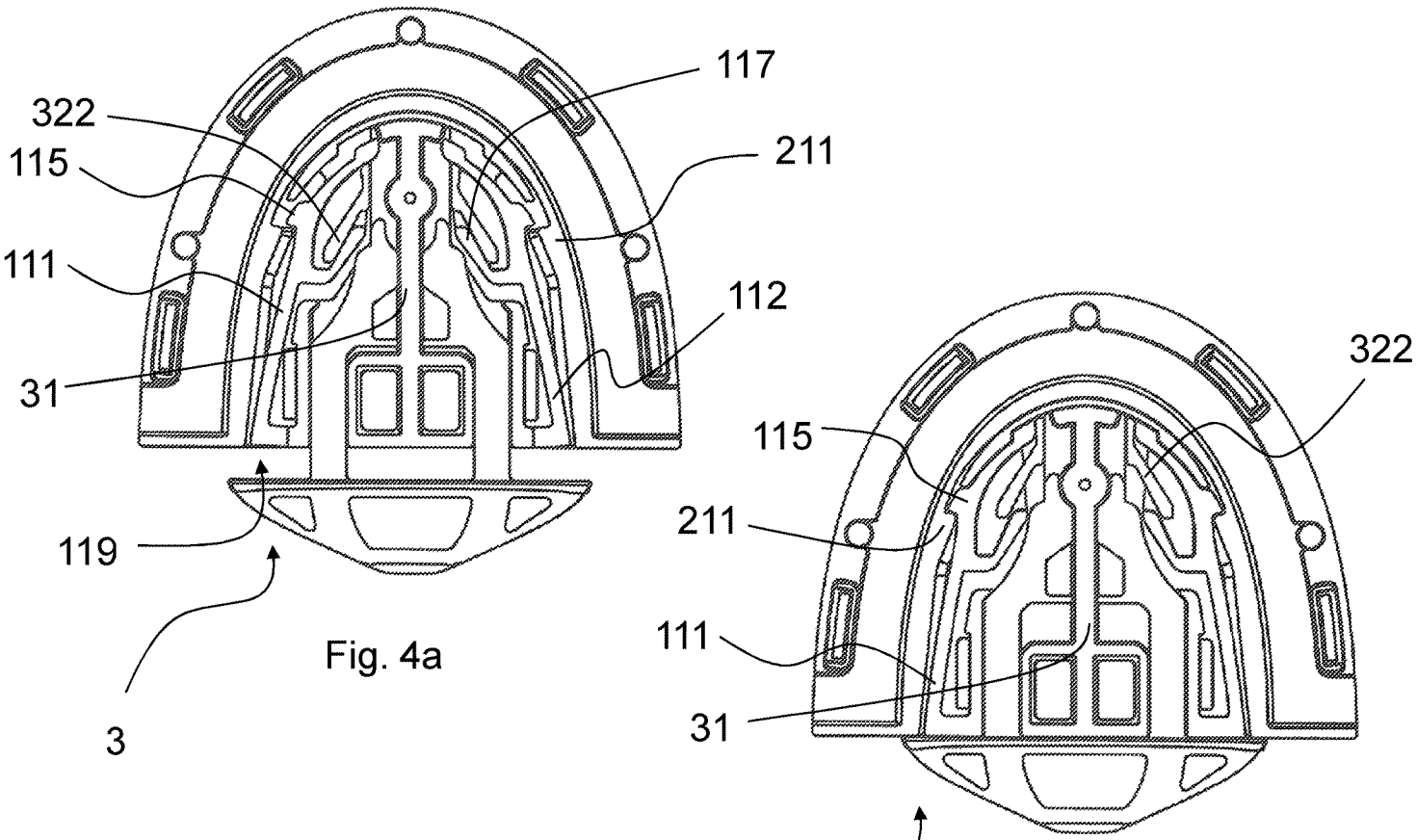
Figure 4B:
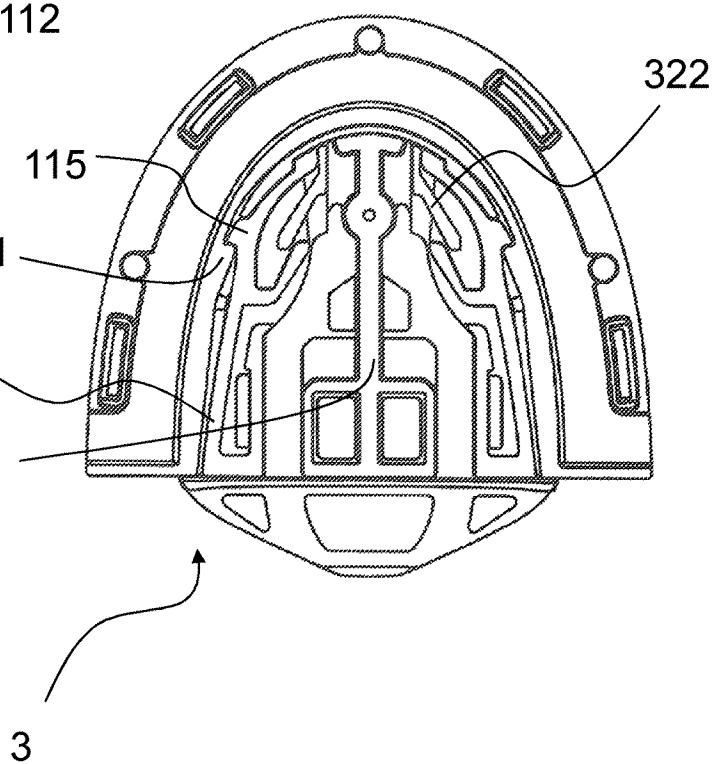

FIGS. 4*a* and 4*b* show the two active unlocked and locked states of the male element 1 relative to the female element 2.

As clearly shown by the figures, the slider 3 moves from a rearwardmost state, as shown in FIG. 4*a*, corresponding to the active unlocked state, to a forwardmost state, as shown in FIG. 4*b*, corresponding to the active locked state.

As clearly shown in FIGS. 4*a* to 5*b*, the device of the present invention has such a design that the slider has a stroke with two limit stop position, one for the rearwardmost state and the other for the forwardmost state.

Particularly referring to the above mentioned figures, the slider 3 is provided at the longitudinal axis of the male element 1, whereas the first locking members are placed at the sides of the slider 3, and each have a first engagement tooth 115 which connects to a corresponding second engagement tooth 211 on the inner walls of the female element 2.

Figure 5B:
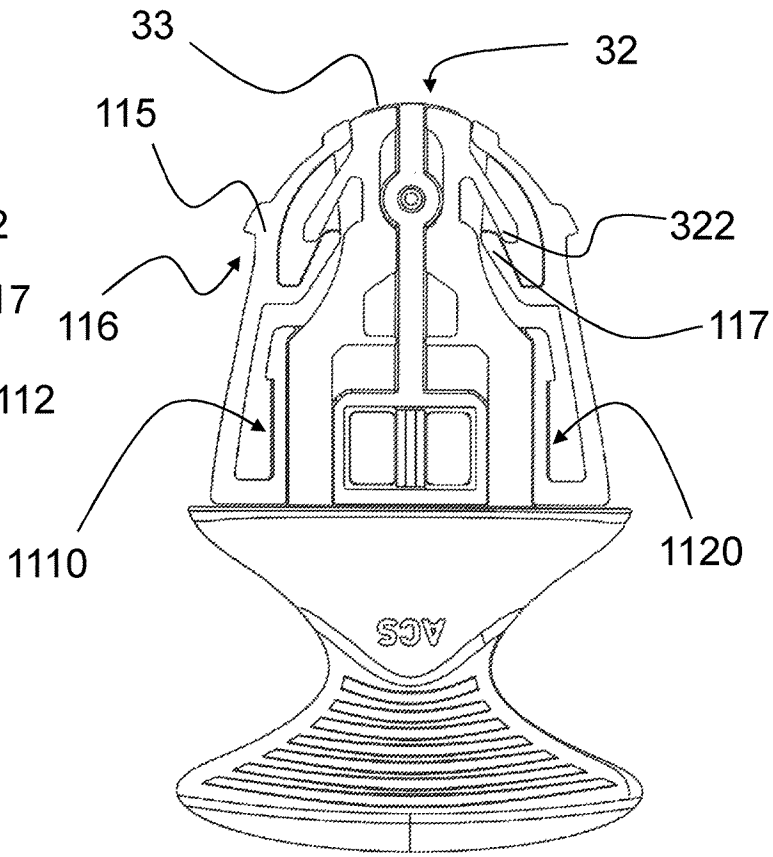
Figure 5A:
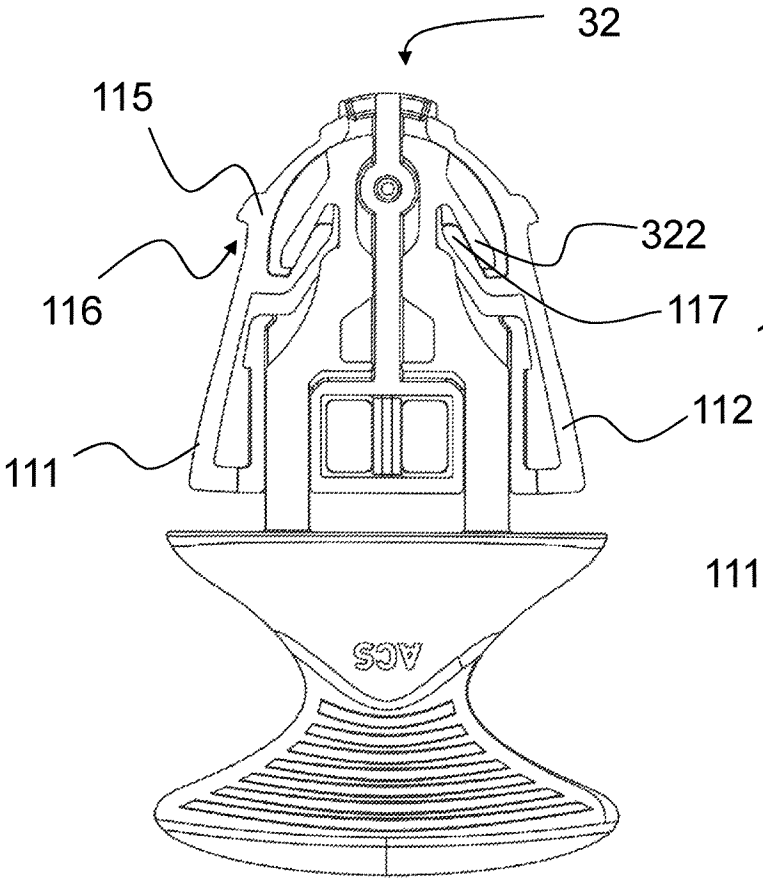

Particularly, each of the two first locking members consists of a rigid element made of an elastically deformable material, and these rigid elements 111 and 112 are in a stable maximum close-together relationship, as shown in FIG. 5*a*, when the slider 3 is in the rearwardmost state, whereas the two rigid elements 111 and 112 are in a maximum spaced-apart relationship when the slider 3 is the forwardmost state.

In this construction, the two rigid elements 111 and 112 are susceptible to elastic deformation either in their maximum spaced-apart relationship or in their maximum close-together relationship, or in both.

If the two rigid elements 111 are 112 are elastically deformed when they are in their maximum spaced-apart relationship, i.e. when the slider 3 is in the forwardmost state, they are elastically loaded and automatically snap back to their close-together relationship due to the inherent elasticity of the material, as soon as the slider 3 starts its rearward stroke.

A similar situation occurs if the two rigid elements 111 and 112 are elastically deformed when they are in their close-together relationship.

According to a possible embodiment, the two rigid elements 111 and 112 may also be hinged to the base, which means that they may be free to move without being subjected to any deformation: the movement from engagement to disengagement is generated by the axial forward-rearward movement of the slider 3 which pushes the two rigid elements 111 and 112 outwards in the forwardmost state, and pulls the two rigid elements 111 and 112 inwards in the rearwardmost state.

As described hereinbelow, according to a preferred variant embodiment of the device of the present invention, the movement of the rigid elements 111 and 112, and particularly their inward movement to their maximum close-together relationship, is obtained due to the provision of guide wings 322 cooperating with stop wings 117.

Particularly referring to FIGS. 5*a* and 5*b*, the two first locking members consist of two peripheral tongues 111 and 112, which have an outer tapered lead-in end section, preferably curved.

With particular reference to the illustrated variant embodiment, the end section of each tongue 111 and 112 comprises the first engagement tooth 115.

Particularly, at a given distance from the end section, each tongue 111 and 112 has the first engagement tooth 115 formed by a recess 116 in the tongue 111 and 112, which is located at the connection area with the substantially longitudinal straight section of the tongue.

The enlarged head 32 of the slider 3 has a curved surface 33, on the outer side facing toward the female element 2, which connects to the two end sections of the tongues 111 and 112 in the forwardmost state of the slider 3, as shown in FIG. 5*b*, thereby forming a seamless surface therewith.

Particularly, the curved surface 33 has an arched section whose length corresponds to the maximum spaced-apart length between the two wings 111 and 112, when the slider 3 is in its forwardmost state.

Figure 6A:
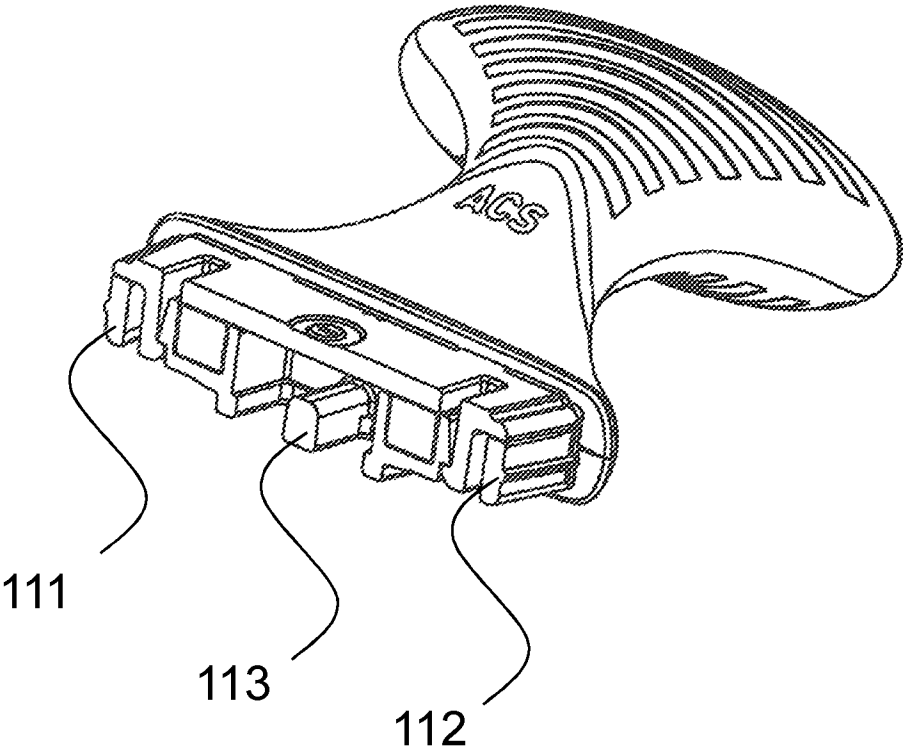
Figure 6B:
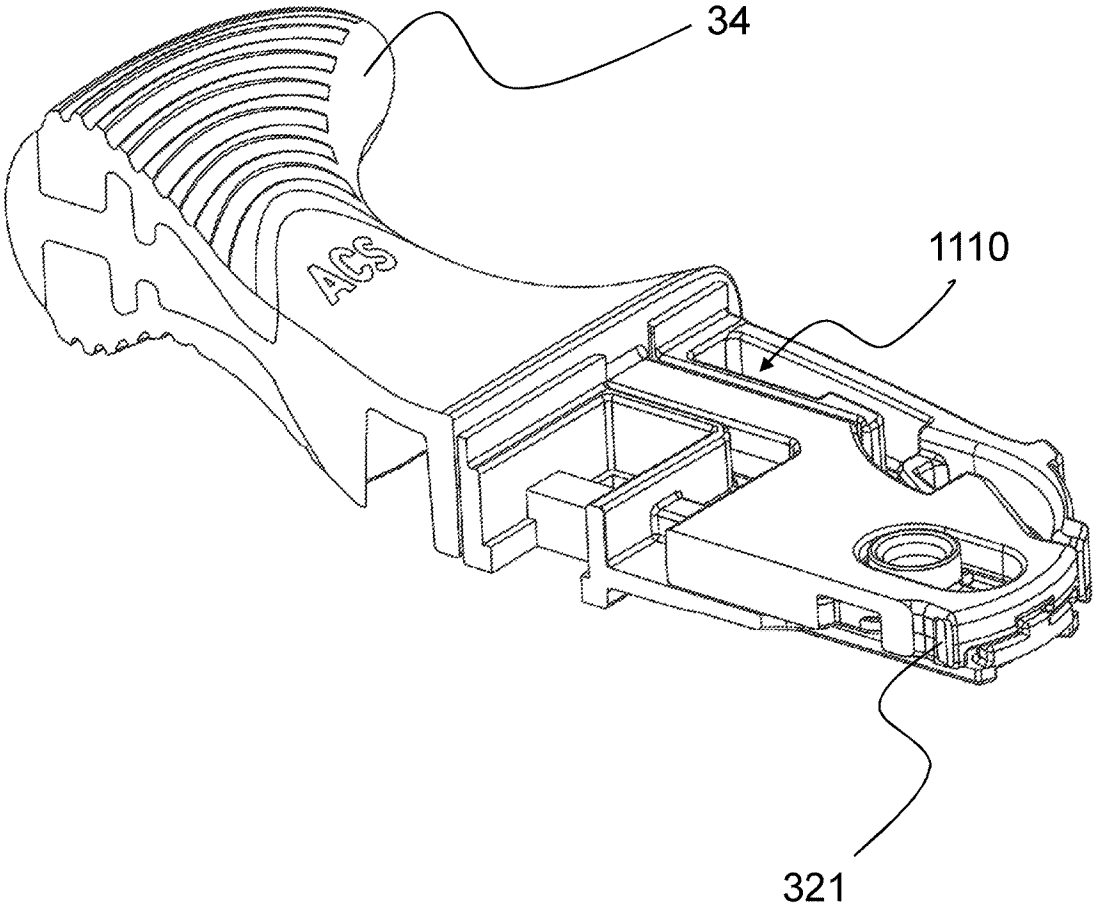

Furthermore, the enlarged head 32 has two head edges 321, as shown in FIG. 6*b*, at each end, which are adapted to cooperate with corresponding end head edges of the end sections of the two tongues 111 and 112.

Therefore, the head edges 321 of the enlarged head 32 have abutment surfaces for the head edges of the tongues 111 and 112, such that the two tongues 111 and 112 are symmetrically pushed and held in the maximum spaced-apart relationship as the slider 3 moves from the rearwardmost state to the forwardmost state.

Figure 2A:
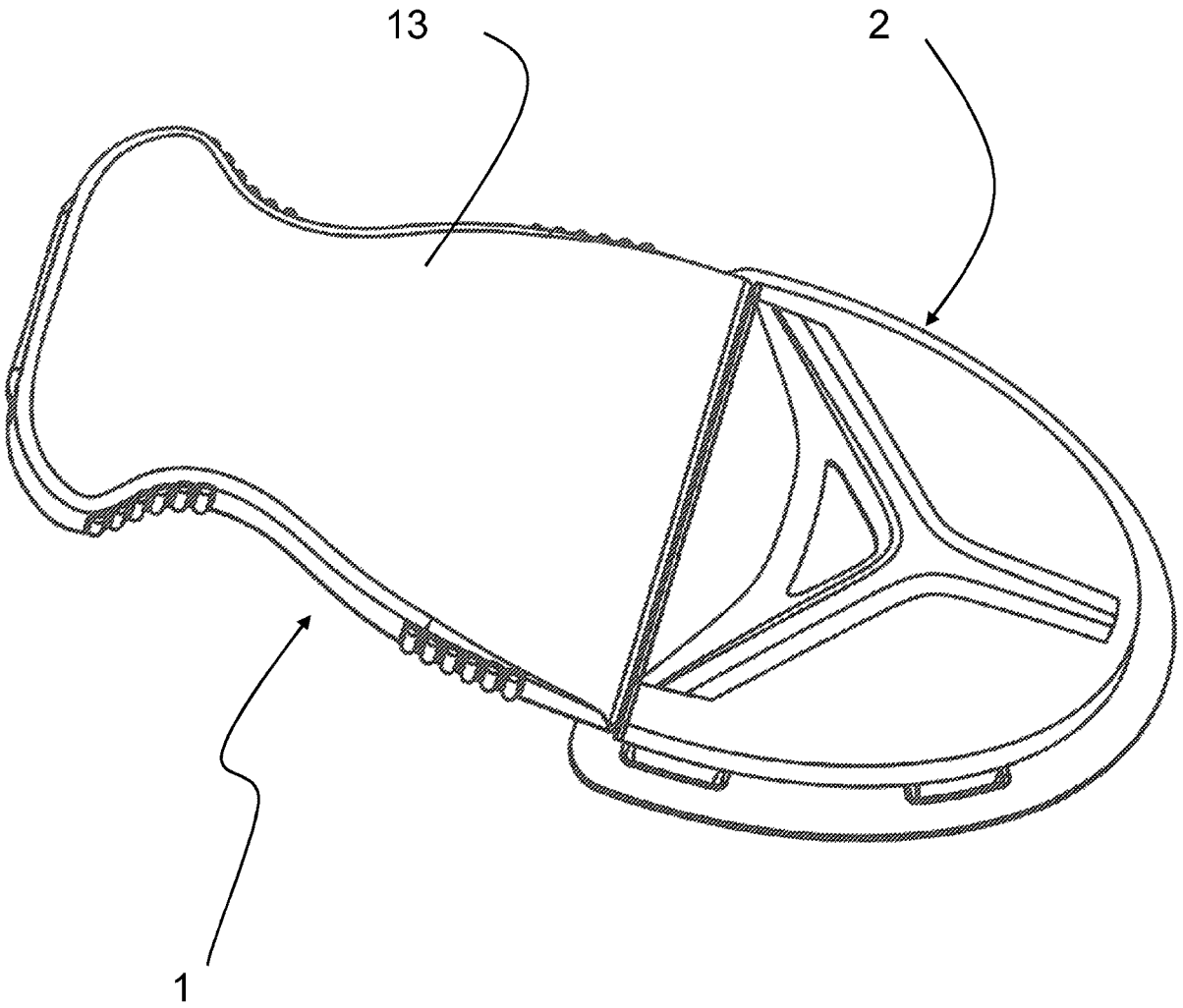
Figure 2B:
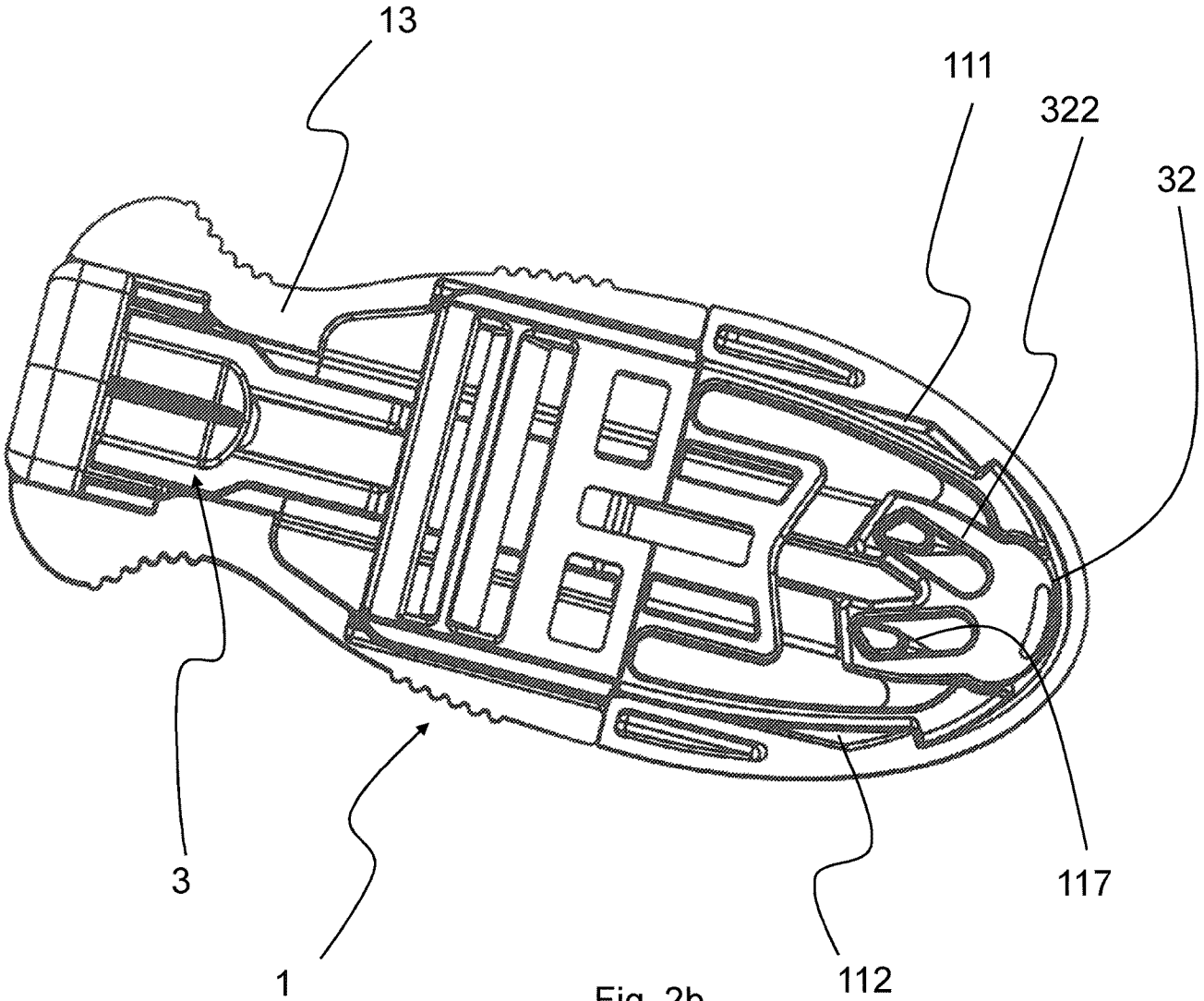
Figure 2C:
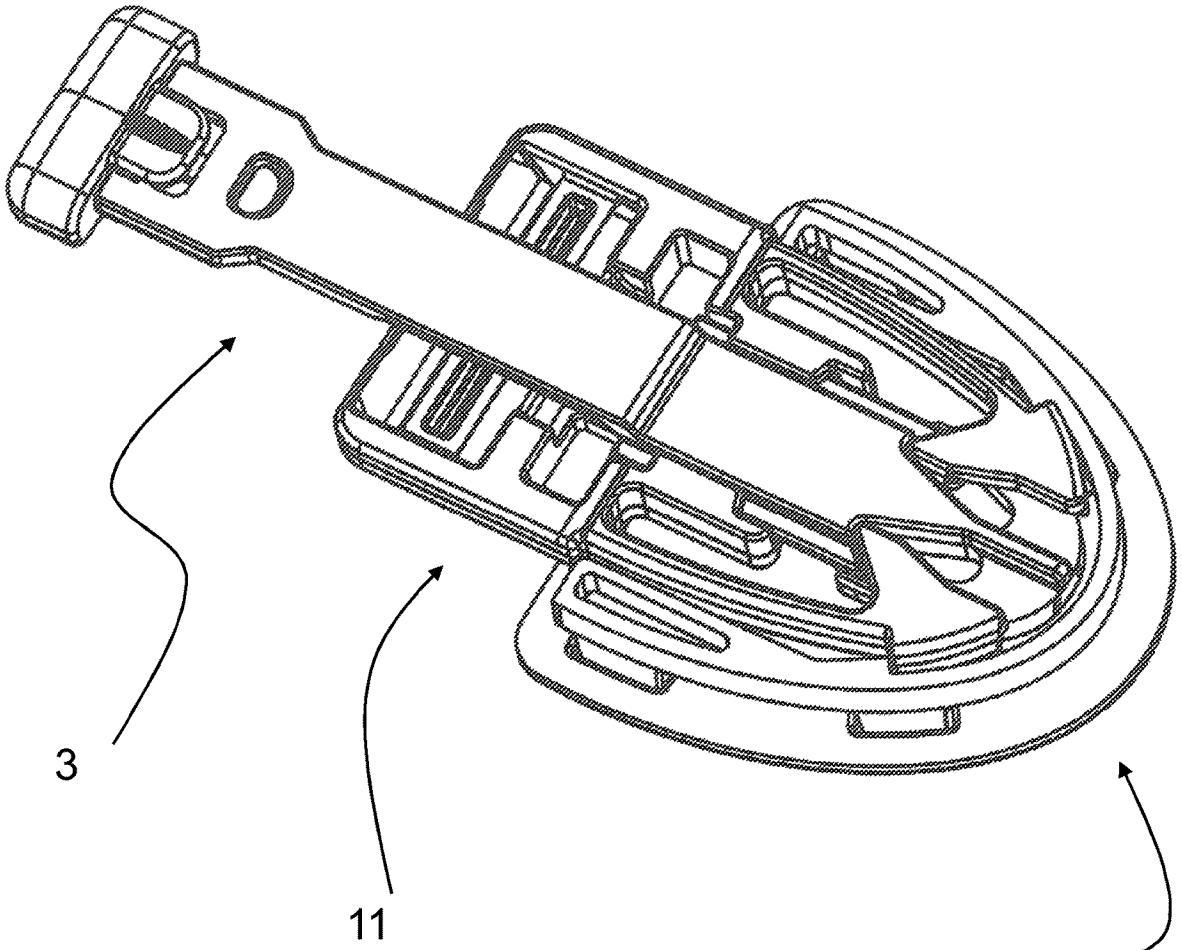

Particularly referring to FIGS. 5*a*, 5*b* and 2*b*, the enlarged head 32 has two extensions 322, which are part of the elongate element 31 and are placed behind the curved surface 33 and the enlarged head 32.

These extensions 322 are inclined to the axis of insertion, and form two guide wings 322 cooperating with stop wings 117.

Each tongue 111 and 112 has a stop wing 117, which extends with a given inclination toward the guide wings 322, and cooperates with the guide wings 322 to ensure that the tongues move as desired, i.e. that they are spaced apart during insertion and that they are drawn close together during removal, thereby ensuring locking engagement or disengagement in response to a push or pull action on the slider 3.

The presence of the stop wings 117 and the guide wings 322, as well as the presence of the abutment surfaces of the head edges of the enlarged head 32 and the tongues 111 and 112, provides two snap-fit interlocking connections as the slider 3 is in its forwardmost and rearwardmost states.

Advantageously, the guide wings 322 and the stop wings 117 act as stabilization guides, which have an opposing action during the stroke of the slider 3.

Particularly, as clearly shown in FIGS. 2*b*, 5*a* and 5*b*, when the slider 3 is in its rearwardmost state, the tongues 111 and 112 are stably held in their close-together relationship due to the contact of the wings 322 and 117, and likewise then the slider 3 is in its forwardmost state, the tongues 111 and 112 are stably held in their spaced-apart relationship due to the contact with the head edge 321 with the end of the engagement tooth 115 and due to the contact between the wings 322 and 117.

From the rearwardmost state, as shown in FIG. 5*a*, to the forwardmost state, as shown in FIGS. 2*b* and 5*b*, the guide wings 322 slide on the top surface of the abutment wings 117.

Therefore, contact of the wings 322 and 117 is maintained from the rearwardmost state to the forwardmost state.

The movement of the rigid elements 111 and 112 from their maximum close-together relationship to their maximum spaced-apart relationship generates a negligible elastic stress.

Indeed, the movement of the rigid elements 111 and 112 which causes the engagement tooth 115 to engage with the inner walls of the female element 2 is caused by the movement of the slider 3 which, in its forwardmost state, pushes the rigid elements 111 and 112 outwards with respect to the elongate element 31.

Likewise, in the rearwardmost state, the slider 3 pulls the elongate elements 111 and 112 near it, to their maximum close-together relationship.

Contact of the wings 117 and 322 during the stroke of the slider 3 affords both a stable maximum close-together relationship and a stable maximum spaced-apart relationship of the two rigid elements 111 and 112.

FIGS. 6*a* to 8 show a variant embodiment of the device of the present invention, representing the particular conformation of the parts of the device, and particularly how they are divided and assembled together. Particularly, here the handle and slider elements form a single piece, as previously described with reference to FIGS. 1*i*, 1*l*, 5*a* and 5*b*, but the features that will be described below will also apply to the embodiment of the inventive device in which the slider 3 is slidably housed within the handle 13, as shown in FIGS. 1*a* to 1*h* and in FIGS. 2*a* to 2*c*.

Particularly, the female element 2 consists of a pocket element which can receive the male element 1 therein, the second engagement tooth 211 being provided on the inner walls of said pocket element.

Figure 7:
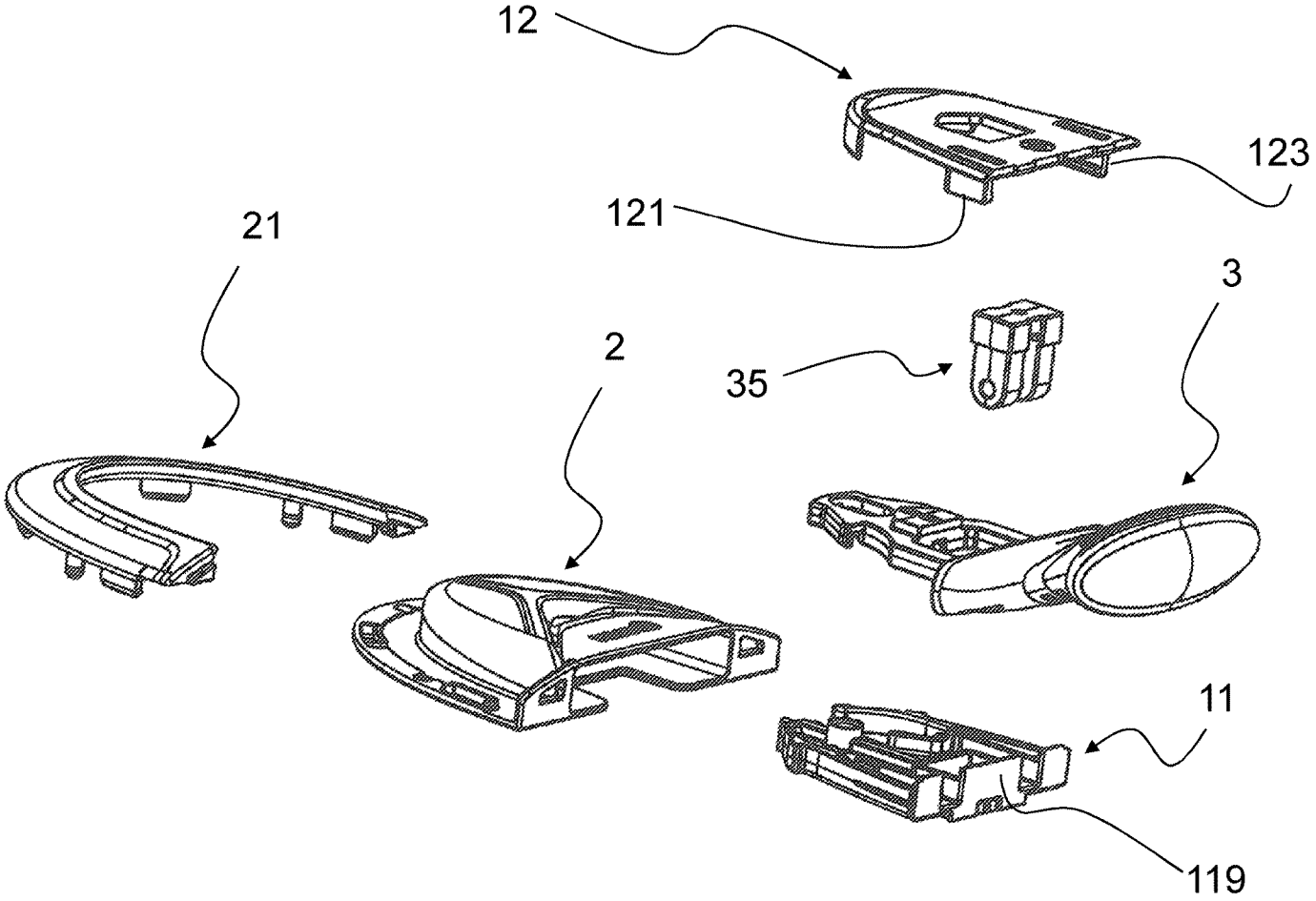
FIG. 7 shows an exploded view of the device of the present invention.

According to the variant embodiment as shown in FIG. 7, the female element 2 has fixation means 21, for fixing the female element 2 to the diving jacket 4.

The male element 1 consists of a first bottom part 11 comprising two peripheral tongues 111 and 112 and a central housing channel for slidably housing the slider 3.

Furthermore, the male element 1 comprises a second lid part 12, which connects to the first bottom part 11 for slidable engagement of the slider 3 therein.

The male element 1 is preferably connected to the weight envelope by means of fixation members, in any manner known in the art.

Figure 8:
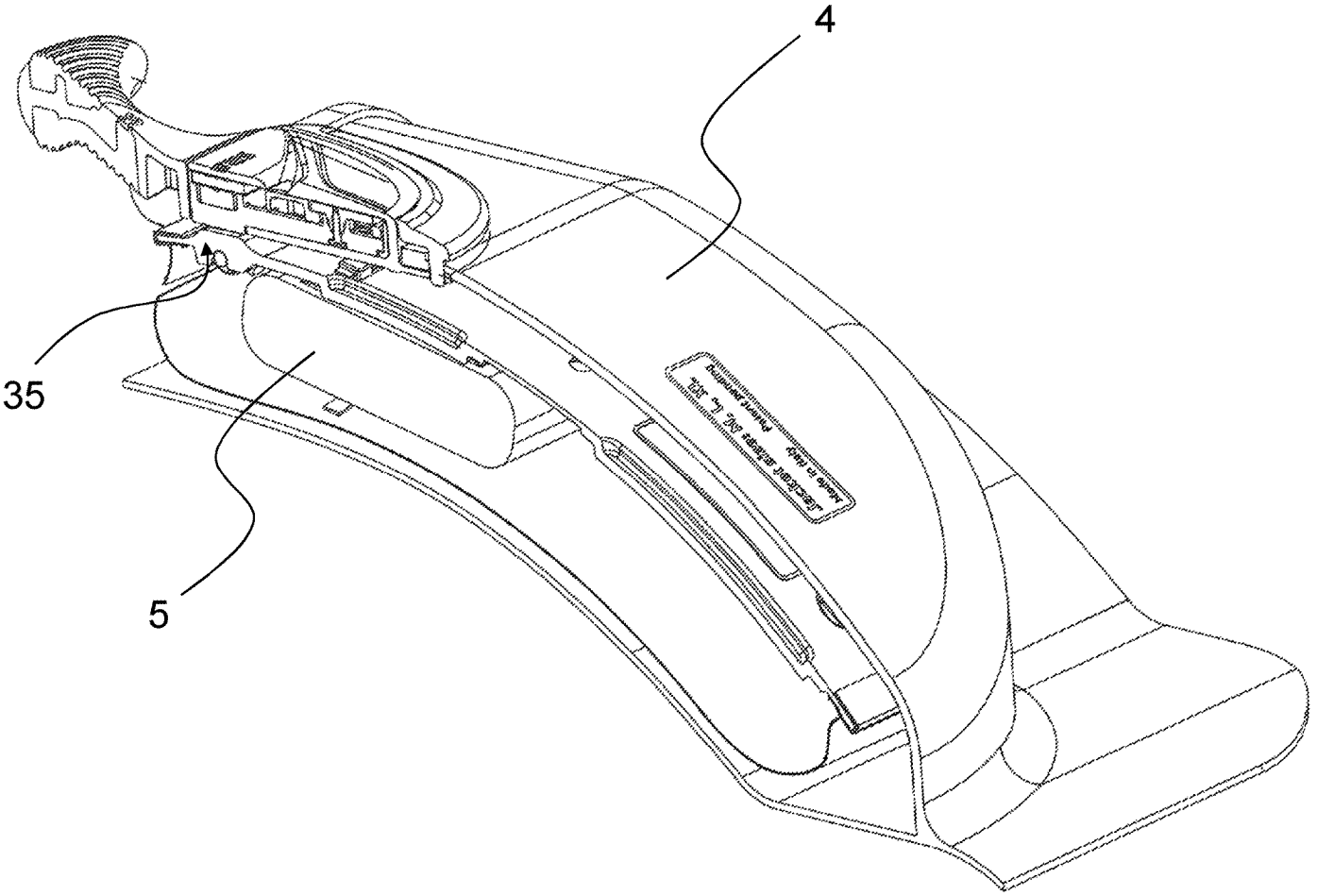
FIG. 8 shows a lateral view of the device of the present invention, connected to a weight pocket.

FIG. 8 particularly shows the use of the reversible connection device of the present invention, as connected to a weight pocket 5.

Various fixation members may be envisaged in this case.

According to a first embodiment, the fixation members may consist of a connector element 35, as shown in FIGS. 7 and 8.

The connector element 35 has such a shape that a polyurethane element may be used, with one end cooperating with the connector element 35 and the other end cooperating with the weight envelope.

Alternatively, a ribbon or the like may be used.

Figure 2D:
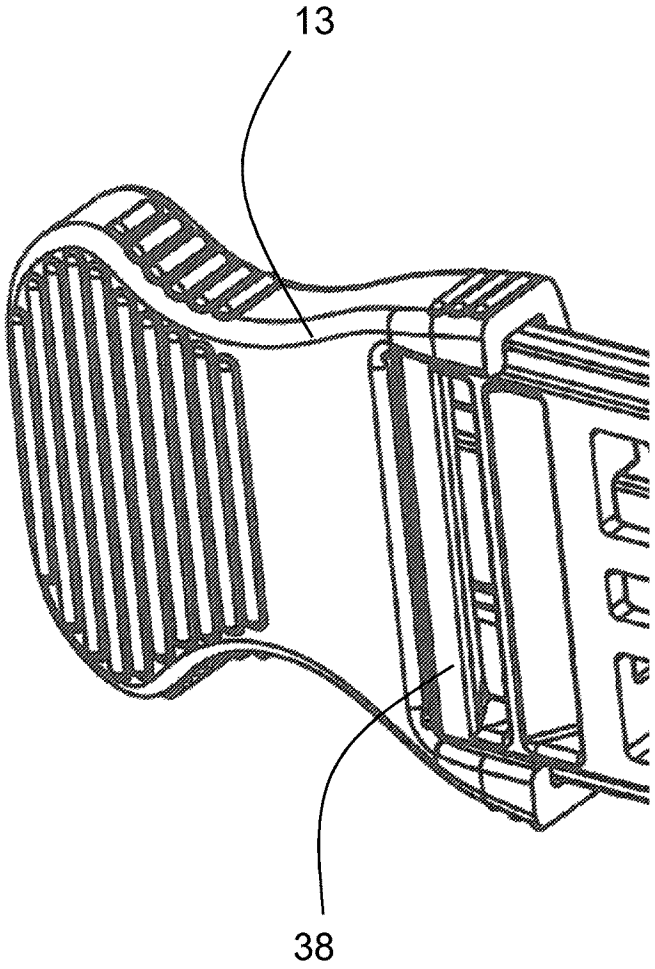

For example, particularly referring to FIG. 2*d*, the fixation members may consist of a buckle having a belt guiding element 38 which is adapted to receive a ribbon therethrough for connection of the weight pocket 5.

Particularly referring to FIGS. 5*a* to 8, the first bottom part 11 is formed of one piece, and consists of a frame having a rear wall 119 with five posts extending from such wall, i.e. two peripheral posts 111 and 112, two inner posts 1110, 1120 and a central channel 113.

In this variant, the peripheral posts 111 and 112 form the above described tongues, whereas the central channel 113 forms a guide element for facilitating the proper sliding movement of the slider 3.

Advantageously, the inner posts 1110 and 1120 have connection seats for corresponding connection teeth 121, 123 of the second lid part 12, which allow the bottom part 11 and the lid part 12 to be assembled and locked together.

Further locking elements may be also provided, such as screws, pins or the like, which fix the parts of the inventive device together.

These pins, screws or the like may have engagement seats formed in the thickness of the body of the male element 1.

Finally, according to the variant embodiment as shown in FIGS. 9*a* and 9*b*, an aperture 122 may be provided on the female element 2, indicating the locked or unlocked state of the device of the present invention.

Particularly, identification symbols 3 may be provided to identify the locked state or the unlocked state.

Depending on the position of the slider 3, the aperture 122 of the female element 2 coincides with a different symbol; in FIG. 9*a*, the slider is in its rearwardmost position and the aperture 122 indicates the locked state, whereas in FIG. 9*b* the slider is in its forwardmost position and the aperture 122 indicates the locked state.

FIGS. 10*a* and 10*b* show a variant embodiment of the device of the present invention, and particularly a section of the device of the present invention in the unlocked and locked states respectively;

Particularly, the figures show an embodiment in which the guide wings 132 and the stop wings 117 of the previous figures are not provided.

Also in this case the two first locking members consist of two tongues 111 and 112.

The enlarged head 32 has two head edges at each end, which are adapted to cooperate with corresponding end head edges of the end sections of the two tongues 111, 112.

Like in FIGS. 4*a* and 4*b*, the head edges of the enlarged head 32 form abutment surfaces 323 for the head edges of the tongues 1111 and 1121, such that the two tongues 111 and 112 are symmetrically pushed and held in a maximum spaced-apart relationship, as shown in FIG. 10*b*, as the slider 3 moves from the rearwardmost state to the forwardmost state.

When the tongues 111 and 112 are in their maximum spaced-apart relationship, the teeth 115 and 116 are engaged with the corresponding engagement seats on the female element 2, to thereby attain the locked state.

Once the slider 3 is moved back to the rearwardmost state, as shown in FIG. 10*a*, the tongues 111 and 112 tend to move back to their maximum close-together relationship.

As mentioned above, the maximum close-together relationship may be obtained in a different manner and in according with different embodiments.

Particularly referring to FIGS. 10*a* and 10*b*, the maximum close-together relationship of the tongues 111 and 112 is attained due to their inherent elasticity.

A possible alternative thereto is that the slider 3, and particularly the enlarged head 32, will pull the tongues 111 and 112 back as the slider 3 moves from the forwardmost state to the rearwardmost state.

A configuration of this particular alternative is, for example, the one as shown in the previous figures, in which the action of the guide wings 132 with the stop wings 117 allows the slider 3 to pull the tongues 111 and 112 to their maximum close-together relationship.

Generally, when not depending on the inherent elasticity of the tongues 111 and 112, members may be provided in the enlarged head 32 for moving the tongues 111 and 112 as the slider 3 moves from the forwardmost state to the rearwardmost state and vice versa, i.e. members whose action is similar to that of the guide wings 132 and the stop wings 117.

A possible arrangement will be now described with reference to FIGS. 11*a*, 11*b* and 11*c*.

According to a possible embodiment, the abutment surfaces 323 and the end surfaces 1111 and 1121 may have such a shape that, in a locked state, as the male element 1 is pulled out of the female element 2, the tongues 111 and 112 are compressed and the slider 3 is moved from a forwardmost state to a rearwardmost state.

Furthermore, according to a variant embodiment, as shown in FIG. 10*b*, the two tongues 111 and 112 have an outer tapered lead-in end section, preferably curved.

The enlarged head 32 of the slider 3 has a curved surface 33, on the outer side facing toward the female element, which curved surface 33 connects to the two end sections of the tongues 111 and 112 in the forwardmost state of the slider 3, thereby forming a seamless surface therewith.

FIGS. 11*a*, 11*b* and 11*c* show a further variant embodiment of the device of the present invention.

In this variant embodiment, the enlarged head 32 has two grooves 324 inclined to the sliding axis of the slider 3, which are adapted to cooperate with the tongues 111 and 112 to drive the two tongues 111, 112 outwards as the slider 3 moves from the rearwardmost to the forwardmost state and inwards as the slider 3 moves from the forwardmost state to the rearwardmost state, such that the two tongues 111, 112 are symmetrically pushed and held in a maximum spaced-apart relationship as the slider 3 moves from the rearwardmost state to the forwardmost state and such that the two tongues 111, 112 are symmetrically pulled and held in a maximum close-together relationship as the slider moves from the forwardmost state to the rearwardmost state.

Still particularly referring to FIGS. 11*a* and 11*b*, the tongues 111 and 112 are hinged to the bottom part 11 by means of hinges 5.

Particularly referring to FIGS. 11*a* and 11*b*, the tongues 111 and 112 are located on two different sides of the bottom part 11, but they may be obviously also located on the same side.

If the tongues 111 and 112 are located on the two opposites sides of the bottom part 11, two different sliders 3 may be provided, one slider 3 for each tongue 111 and 112, for moving the latter.

Alternatively to the above, it will be understood that two independent sliders 3 may be also provided, even when the tongues 111 and 112 are located on the same side of the bottom part 11.

Particularly in FIG. 11*a*, the slider 3 is in its rearwardmost state, the tongues 111 and 112 are in a maximum close-together relationship and the male element is released from the female element.

In FIG. 11*b*, the slider is in its forwardmost state, the tongues 111 and 112 are in a maximum spaced-apart relationship and the male element 1 is fixed to the female element 2, due to the action of the teeth 115 and 116 which are engaged with the corresponding engagement seats on the female element 2.

The enlarged head 32 and the end portion of the tongues 111 and 112 may have such shapes as to allow the enlarged head 32 to push the tongues 111 and 112 to their maximum spaced-apart relationship as the slider 3 moves forward, and to allow the enlarged head 32 to pull the tongues 111 and 112 back as the slider moves rearward.

This movement may be obtained, for instance, by interaction of the contact surfaces of the enlarged head 32 and the tongues 111 and 112 as well as by the hinges 5 that allow rotation of the tongues 111 and 112.

Alternatively, the enlarged head 32 may be only designed to push the tongues 111 and 112 to their maximum spaced-apart relationship but, once the slider 3 is in the rearwardmost state, these tongues will be free to oscillate due to the presence of the hinges 5 and hence the male element may be pulled off the female element 2.

According to a further embodiment elastic elements, such as springs, may be provided within the hinges 5 to force the tongues 111 and 112 to remain in their close-together relationship.

Particularly, as mentioned above, this variant embodiment has the purpose of including all the above described features, alternatively to or in combination with one another, and is used in the automotive field, as an emergency arrangement for unfastening seat belts after an accident, e.g. if the normal unfastening button cannot be easily accessed.

This variant is clearly shown in FIG. 11*c*. The ends of the seat belt may be sewn after extending through the slits 6 of the male element 1 and the female element 2 respectively.

Thus, the male element 1 is fixed to the female element 2 and, in an emergency, the slider/s 3 are actuated to move the tongues and release the male element 1 from the female element 2.

Therefore, the male element 1 will be released from the female element 2 by simply acting upon the eyelet situated at the end opposite to the enlarged head 32 and connected to the slider 3, e.g. by inserting one finger therein and pulling.

Finally, based on the above described features and the suggested variant embodiments of the device of the present invention, it will be appreciated that the embodiment with the handle 13 as shown in FIGS. 1*a* to 2*d* may be provided in combination with all the embodiments as shown in FIGS. 3*a* to 11*c*.

The invention claimed is:

1. A device for reversibly connecting together a first element and a second element, the first and the second elements being designed to be connected and disconnected, the device comprising:

a male element adapted to be connected to one end of the first element, the male element comprising first locking members extending outwardly and third locking members extending inwardly;

a female element adapted to be connected to one end of the second element and to receive the male element, the female element comprising second locking members extending inwardly, the male element and the female element being adapted to move from a locked state to an unlocked state and vice versa; and a slider that causes actuation and release of the locked state, the slider being slidingly engaged by the male element along an axis of insertion of the male element into the female element, wherein the slider comprises an elongate element having a head facing the female element and with lateral cavities defined therein, wherein the male element comprises a handle having the slider at least partially and slidingly housed therein, wherein a relative movement of the slider in relation to the male element toward the female element causes the lateral cavities in the head of the slider to engage the third locking members of the male element, wherein a continuing movement of the slider in relation to the male element toward the female element further causes an outward movement of an outer surface of the male element and the first locking members to engage the second locking members, thereby causing the male element and the female element to be in the locked state.

2. The device according to claim 1, wherein a relative movement of the slider in relation to the male element away from the female element causes an inward movement of the outer surface of the male element and the first locking members to disengage from the second locking members, thereby causing the male element and the female element to be in the unlocked state.

3. The device according to claim 1, wherein the handle and the slider are formed as one piece.

4. The device according to claim 1, wherein the handle has a housing seat configured to receive an end of the slider, the housing seat being formed within a thickness of walls of the handle and having abutment surfaces for abutment against corresponding outer surfaces of the slider, and wherein a movement of the handle in a direction opposite to a direction of insertion causes the abutment surfaces to abut the corresponding outer surface of the slider, thereby causing the slider to move in the direction opposite to the direction of insertion.

5. The device according to claim 1, wherein the handle has a hole at an end opposite to the female element, the hole making the slider accessible from outside of the handle.

6. The device according to claim 1, wherein the first locking members are shaped as two tongues extending outwardly from the outer surface of the male element, and wherein the second locking members are shaped as two cavities defined on an inner surface of the female element and shaped to receive the two tongues.

7. The device according to claim 1, wherein the third locking members are shaped as tongues extending inwardly from an inner surface of the male element.

8. The device according to claim 1, wherein the head of the slider has a narrower width than a central portion of the slider, the narrower width being caused by an inward tapering of the slider toward the female element after the lateral cavities.

9. The device according to claim 1, wherein the first element is a weight pocket, and the second element is at least part of a diving jacket, the male element having fixation members for fixation of the weight pocket.

* * * * *